US007568910B2

(12) United States Patent
Serizawa et al.

(10) Patent No.: US 7,568,910 B2
(45) Date of Patent: Aug. 4, 2009

(54) IGNITOR

(75) Inventors: Nobuyuki Serizawa, Shizuoka (JP); Yoshimitsu Kaga, Shizuoka (JP); Yoshihiro Kashoji, Shizuoka (JP)

(73) Assignee: Tokai Corporation, Tokyo (JP)

( * ) Notice: Subject to any disclaimer, the term of this patent is extended or adjusted under 35 U.S.C. 154(b) by 355 days.

(21) Appl. No.: 10/493,473

(22) PCT Filed: Oct. 22, 2002

(86) PCT No.: PCT/JP02/10957

§ 371 (c)(1),
(2), (4) Date: Apr. 23, 2004

(87) PCT Pub. No.: WO03/036171

PCT Pub. Date: May 1, 2003

(65) Prior Publication Data

US 2005/0037304 A1 Feb. 17, 2005

(30) Foreign Application Priority Data

Oct. 23, 2001 (JP) ..... 2001-324895
Oct. 23, 2001 (JP) ..... 2001-324896
Nov. 19, 2001 (JP) ..... 2001-353205

(51) Int. Cl.
*F23D 11/36* (2006.01)
*F23Q 1/02* (2006.01)

(52) U.S. Cl. ..... 431/153; 431/273; 431/274

(58) Field of Classification Search ..... 431/153, 431/255, 344, 345, 154, 133, 137, 259, 273, 431/274, 275, 276, 277
See application file for complete search history.

(56) References Cited

U.S. PATENT DOCUMENTS 5,197,870 A * 3/1993 Yang ..... 431/153

(Continued)

FOREIGN PATENT DOCUMENTS

CA 2156378 2/1996

(Continued)

*Primary Examiner*—Marc E Norman
(74) *Attorney, Agent, or Firm*—Trojan Law Offices

(57) ABSTRACT

In an igniter which is ignited by rotation of an actuator, ignition of the igniter is disabled by a simple rotation of the actuator in the initial state or in the non-used state and the ignition lock can be released in a series of igniting actions without preventing the automatic return of the igniter to the locked state, while ensuring excellent operability of the igniter. The igniter is provided with an actuator mechanism (5) for carrying out an igniting operation on a valve mechanism (7) for controlling supply of gas from a reservoir portion (2) to a gas nozzle (9) in an end portion of a rod-like portion (4) and an ignition mechanism (8). The actuator mechanism (5) comprises a rotatable actuator (51), a fulcrum member (52) about which the actuator is rotated, and an interlocking member (53) which operates a piezoelectric unit (8). The igniting operation of the actuator (51) involves rotation of the actuator about the fulcrum member in one direction and an auxiliary operation of the actuator to be done in continuous with rotation of the actuator in a direction different from said one direction with the actuator mechanism automatically returned to its initial state in response to return of the actuator to its initial position.

6 Claims, 21 Drawing Sheets

U.S. PATENT DOCUMENTS

| | | | | | |
|---|---|---|---|---|---|
| 5,697,775 | A | | 12/1997 | Saito et al. | 431/153 |
| 5,897,308 | A | | 4/1999 | Saito et al. | 431/153 |
| 5,975,888 | A | * | 11/1999 | Hsu | 431/255 |
| 6,022,212 | A | | 2/2000 | Saito et al. | 431/153 |
| 6,042,367 | A | | 3/2000 | Saito et al. | 431/153 |
| 6,093,017 | A | | 7/2000 | Saito et al. | 431/153 |
| 6,116,892 | A | * | 9/2000 | Yang | 431/153 |
| 6,616,443 | B2 | | 9/2003 | Saito et al. | 431/153 |
| 2002/0192612 | A1 | * | 12/2002 | Pan et al. | 431/153 |
| 2003/0096206 | A1 | | 5/2003 | Saito et al. | 431/155 |

FOREIGN PATENT DOCUMENTS

| | | | |
|---|---|---|---|
| CA | 2338842 | | 12/2000 |
| CA | 2 369 488 | | 8/2001 |
| CN | 2239574 | Y | 11/1996 |
| CN | 2453254 | Y | 10/2001 |
| EP | 1 176 365 | | 1/2002 |
| GB | 2292448 | | 2/1996 |
| GB | 2324140 | | 10/1998 |
| JP | 64 (1989)-22159 | | 2/1989 |
| JP | 64-22159 | | 2/1989 |
| JP | 8-61673 | | 3/1996 |
| JP | 2000-55364 | | 2/2000 |
| JP | 2001-215014 | | 8/2001 |
| WO | 01/57444 | | 8/2001 |

* cited by examiner

IGNITOR

This is a national stage of PCT/JP02/10957 filed Oct. 22, 2002.

FIELD OF THE INVENTION

This invention relates to an igniter which ejects gas and ignites the gas in response to operation of an actuator which is supported for rotation about a fulcrum, and normally prevents ignition by preventing rotation of the actuator or by preventing full operation or reset of the igniting system while permitting to ignite by releasing these preventions when using the igniter.

BACKGROUND OF THE INVENTION

An igniter, for instance, an igniting rod can ignite by simply pushing an actuator. However, it is required to provide the igniter with, for instance, a lock mechanism which prevents the igniter from accidentally or unintentionally igniting, and accordingly, there have been proposed various igniters provided with various lock mechanisms.

For example, in Japanese Unexamined Patent Publication No. 8(1996)-61673, there is disclosed an igniter in which a lock member having a part which interferes with a part of an actuator to prevent the igniter from igniting is provided to be movable in a direction intersecting the direction of movement of the actuator, an urging member is disposed to urge the lock member toward its locking position, and the lock member has a lock release portion for moving the lock member overcoming the urging member in the vicinity of the actuator.

However, such a lock mechanism is of a type in which the actuator is slid and cannot be applied as it is to an igniter of a type to which the present invention is applied and in which the actuator is rotated.

Further, in such a lock mechanism, it is necessary to operate another member such as a lock release member remote from the actuator prior to the igniting action by the actuator, which makes it necessary a multiple stages of actions for the igniting action, and deteriorates the operability of the igniter. It is preferred that the lock mechanism be such that the igniter can be stably shifted to an igniting state by a series of actions and can be automatically shifted to the initial state where ignition of the igniter is disabled in response to release of the actuator from the finger.

In view of the foregoing observations and description, the primary object of the present invention is to provide an igniter having an actuator mechanism which can stably take the ignition lock state so that the ignition lock state can be easily released by a series of igniting actions.

SUMMARY OF THE INVENTION

The igniter of the present invention comprises a gas nozzle which is disposed in an end portion of a rod-like portion and discharges gas, a reservoir storing therein fuel, a valve mechanism for controlling supply of gas from the reservoir to the gas nozzle, an ignition mechanism which generates a discharge electric voltage for igniting the gas discharged from the gas nozzle, and an actuator mechanism which is operated to accomplish an igniting action of igniting the gas discharged from the gas nozzle, wherein the improvement comprises that the actuator mechanism comprises a rotatable actuator, a fulcrum member which is supported on an igniter body casing and about which the actuator is rotated and an interlocking member which operates the ignition mechanism in response to rotation of the actuator, and the igniting action of the actuator involves rotation of the actuator about the fulcrum member in one direction and an auxiliary operation of the actuator to be done in continuous with rotation of the actuator, in said one direction, in a direction different from said one direction with the actuator mechanism automatically returned to its initial state in response to return of the actuator to its initial position.

It is preferred that the auxiliary operation of the actuator be operation to move the fulcrum of the actuator. In this case, it is preferred that the fulcrum member extends like a stem on each side of the actuator to be fixed thereto and be supported by a bearing portion, fixed to the igniter body casing, to be able to support the actuator for rotation and to be moved in the auxiliary operation in a direction perpendicular to the direction of the axis of rotation of the actuator.

An actuator mechanism in accordance with a first system comprises a rotatable actuator, a fulcrum member which is supported on an igniter body casing and about which the actuator is rotated, an interlocking member which operates the ignition mechanism in response to rotation of the actuator, a lock member which engages to prevent rotation of the actuator, thereby making an ignition lock, when the actuator is not operated, and an urging member which urges the actuator toward its locking position, wherein the igniting action of the actuator involves making an auxiliary operation of the actuator in one direction to release the engagement of the lock member and then rotating the actuator in a direction different from the direction in which the auxiliary operation of the actuator is made to release the engagement of the lock member.

An example of the actuator mechanism in accordance with the first system is provided with a pair of lock members which are disposed between the fulcrum member and the igniter body casing and are brought into engagement with each other under the urging force of the urging member to make the ignition lock, so that after release of ignition lock by an auxiliary operation of the actuator in one direction to move the fulcrum member overcoming the urging force of the urging member, the actuator is rotated about the fulcrum member for the igniting action in a direction different from the direction in which the auxiliary operation of the actuator is made to release the ignition lock. In this case, the lock members may be projections which are formed on one of the fulcrum member and the igniter body casing and are engaged with engagement portions formed on the other of the fulcrum member and the igniter body casing to make the ignition lock.

Another example of the actuator mechanism in accordance with the first system is provided with a lock member which is disposed between the interlocking member and the igniter body casing and is brought into engagement under the urging force of the urging member to make the ignition lock, so that after release of ignition lock by an auxiliary operation of the actuator in one direction to move the interlocking member overcoming the urging force of the urging member, the actuator is rotated for the igniting action in a direction different from the direction in which the auxiliary operation of the actuator is made to release the ignition lock. In this case, the lock member may be a projection which is formed on one of the interlocking member and the igniter body casing to interfere with an engagement portion formed on the other of the interlocking member and the igniter body casing to make the ignition lock, and is passed through groves formed on the interlocking member or the igniter body casing to permit rotation of the interlocking member.

It is preferred that the urging member comprises a pushing member which slides in response to movement of the actuator toward the lock release direction and a spring which urges the pushing member, and a part of the actuator be in contact with the pushing member to be slidable in response to rotation of the actuator.

An actuator mechanism in accordance with a second system comprises a rotatable actuator, a fulcrum member which is supported on an igniter body casing and about which the actuator is rotated and an interlocking member which operates the ignition mechanism in response to rotation of the actuator, wherein rotation of the actuator is set so that the rotation of the actuator by way of the interlocking member causes the ignition mechanism to be operated by an amount not sufficient to discharge electric voltage, the actuator is movable to a position where it can operate the igniting member by way of the interlocking member by an amount sufficient to discharge electric voltage by an auxiliary operation of the actuator in a direction different from the direction of the rotation of the actuator, and the igniting action of the actuator involves in addition to rotation of the actuator about the fulcrum member, an auxiliary operation of the actuator in a direction different from the direction of the rotation of the actuator to a position where it can operate the igniting member by way of the interlocking member by an amount sufficient to discharge electric voltage.

Further, an actuator mechanism in accordance with a third system comprises a rotatable actuator, a fulcrum member which is supported on an igniter body casing and about which the actuator is rotated, an interlocking member which operates the ignition mechanism in response to rotation of the actuator and a reset prevention member which prevents the ignition mechanism from returning to a reset position, wherein the igniting action of the actuator involves rotation of the actuator after the ignition mechanism is returned to the reset position overcoming the reset prevention member by an auxiliary operation of the actuator in a direction different from the direction of the rotation of the actuator. In this case, it is suitable for the reset prevention member to prevent reset of the ignition mechanism by urging the actuator toward the direction in which the ignition mechanism is operated.

The auxiliary operation of the actuator in the actuator mechanisms in accordance with the second and third systems is suitably an operation to move the position of the fulcrum of the actuator in parallel to the direction in which the ignition mechanism is operated.

The interlocking member in each of the actuator mechanisms in accordance with the first to third systems may comprise a link member which transmits rotation of the actuator to the ignition member.

In the interlocking member in each of the actuator mechanisms in accordance with the first to third systems, at least one of the valve mechanism and the ignition mechanism cannot be operated and accordingly ignition of the igniter is disabled unless the igniting action of the actuator involving rotation of the actuator and the auxiliary operation is continuously done, whereas when the actuator is rotated about the fulcrum member and the auxiliary operation is done before or after the rotation of the actuator continuously therewith, the valve mechanism and the ignition mechanism can be operated and the discharged gas can be ignited. When the actuator is released, the actuator is automatically rotated back to extinguish the igniter and the igniter automatically returns to the initial state where the igniter cannot be ignited by an incorrect operation of the actuator. When the igniter is not in use, an inadvertent ignition of the igniter is thus prevented.

For example, in an igniter provided with an actuator mechanism in accordance with the first system, when the actuator is not operated and in the lock position by the urging member, the igniter is in the ignition lock state where the lock member engages and rotation of the actuator is inhibited. When the actuator is operated to release the ignition lock in the auxiliary operation overcoming the urging member in a direction different from the direction in which the actuator is rotated, the lock member is disengaged to permit rotation of the actuator, whereby fuel gas discharged in response to igniting action of the actuator is ignited. When the actuator is released, the actuator is automatically rotated back to the initial position and the actuator is moved under the force of the urging member to the lock state where the igniter cannot be ignited by an incorrect operation of the actuator.

In an igniter provided with an actuator mechanism in accordance with the second system, when the actuator is simply rotated without the auxiliary operation, the ignition mechanism cannot be operated by way of the interlocking member by an amount sufficient to discharge electric voltage, and accordingly, ignition of the igniter is disabled, whereas when the auxiliary operation is carried out in a direction different to the direction of rotation of the actuator in addition thereto, the ignition mechanism is operated by way of the interlocking member by an amount sufficient to discharge electric voltage and an electric discharge takes place, whereby fuel gas discharged is ignited. When the actuator is released, the actuator is automatically returned to the position where it requires the auxiliary operation to ignite the igniter.

In an igniter provided with an actuator mechanism in accordance with the third system, since returning of the ignition mechanism to the original state is prevented by the reset prevention member and accordingly the ignition mechanism cannot be reset, when the actuator is simply rotated without the auxiliary operation, the ignition mechanism cannot be operated, and accordingly, ignition of the igniter is disabled, whereas when the actuator is rotated after the auxiliary operation is carried out in a direction different to the direction of rotation of the actuator to permit the ignition mechanism to return to the reset position overcoming the reset prevention member, an electric discharge takes place, whereby fuel gas discharged is ignited. When the actuator is released, the actuator is automatically returned to the position where it requires the auxiliary operation to ignite the igniter.

In accordance with another aspect of the present invention, there is provided an igniter which comprises a gas nozzle which is disposed in an end portion of a rod-like portion and discharges gas, a reservoir storing therein fuel, a valve mechanism for controlling supply of gas from the reservoir to the gas nozzle, an ignition mechanism which generates a discharge electric voltage for igniting the gas discharged from the gas nozzle, and an actuator mechanism which is operated to accomplish an igniting action of igniting the gas discharged from the gas nozzle, wherein the improvement comprises that the actuator mechanism comprises an actuator which is movable by a fulcrum member which is supported on an igniter body casing and an interlocking member which operates the ignition mechanism, and the ignition mechanism is brought into abutment against the interlocking member to discharge an electric voltage in response to movement of the actuator for ignition and returns to the initial state in response to return of the actuator to the initial position.

Further, in accordance with still another aspect of the present invention, there is provided an igniter which comprises a gas nozzle which is disposed in an end portion of a rod-like portion and discharges gas, a reservoir storing therein fuel, a valve mechanism for controlling supply of gas from the reservoir to the gas nozzle, an ignition mechanism which generates a discharge electric voltage for igniting the gas discharged from the gas nozzle, and an actuator mechanism which is operated to accomplish an igniting action of igniting the gas discharged from the gas nozzle, wherein the improvement comprises that the actuator mechanism comprises a rotatable actuator, a fulcrum member which is supported on an igniter body casing and about which the actuator is rotated, an interlocking member which operates the ignition mechanism in response to rotation of the actuator, a lock member which is provided on the actuator and a part of which interferes with the igniter body casing to inhibit rotation of the actuator to make an ignition lock when the actuator is not operated, and an urging member which urges the lock member toward the lock position, the igniting action of the actuator involving rotation of the actuator after releasing interference of the lock member with the igniter body casing by lock release operation with the actuator mechanism automatically returned to its initial state in response to return of the actuator to its initial position.

It is preferred that the lock release operation moves the lock member along an actuating portion of the actuator member. In this case, it is preferred that the lock member comprises an actuating portion mounted on the actuator to be slidable along the actuating portion of the actuator and a locking portion which is formed contiguously to the actuator and has an end portion which is able to be projected and retracted from the actuator and can interfere with the igniter body casing, and the urging member urges the locking portion to project.

In such an igniter, when the lock member is not operated and is held in the lock position under the force of the urging member, the igniter is in the locked state where a part of the lock member is in interference with the igniter body casing and rotation of the actuator is inhibited. When the lock member on the actuator is released from the igniter body casing overcoming the urging member, rotation of the actuator is permitted, whereby fuel gas discharged in response to igniting action of the actuator is ignited. When the actuator is released, the actuator is automatically rotated back to the initial position and the lock member is moved under the force of the urging member to the lock state where the igniter cannot be ignited by an incorrect operation of the actuator.

In accordance with the igniters of the present invention, since it is necessary to rotate the actuator and to accomplish the auxiliary operation of the actuator in a direction different from the direction in which the actuator is rotated before or after the rotation of the actuator, or to release ignition lock by the lock member on the actuator prior to rotation of the actuator, it is difficult for those who do not know correct use of the igniter to make the igniter in an ignitable state or to release the ignition lock, whereby inadvertent ignition of the igniter can be prevented, and at the same time, since the igniter is automatically returned to the initial state or the locked state where ignition of the igniter is disabled, the igniter cannot be left in the ignitable state. Further, in the extinguished state, the igniter can be surely held in the unignitable state and the reliability can be improved. Further, the auxiliary operation of the actuator or the lock release operation of the lock member and the igniting operation of the actuator can be smoothly done in a series of actions which makes it unnecessary a multiple stages of actions for the igniting action, and improves the operability of the igniter, whereby stable ignition of the igniter can be obtained.

PREFERRED EMBODIMENTS OF THE INVENTION

Embodiments of the present invention will be described in detail with reference to the drawings, hereinbelow.

First Embodiment

Figure 1:
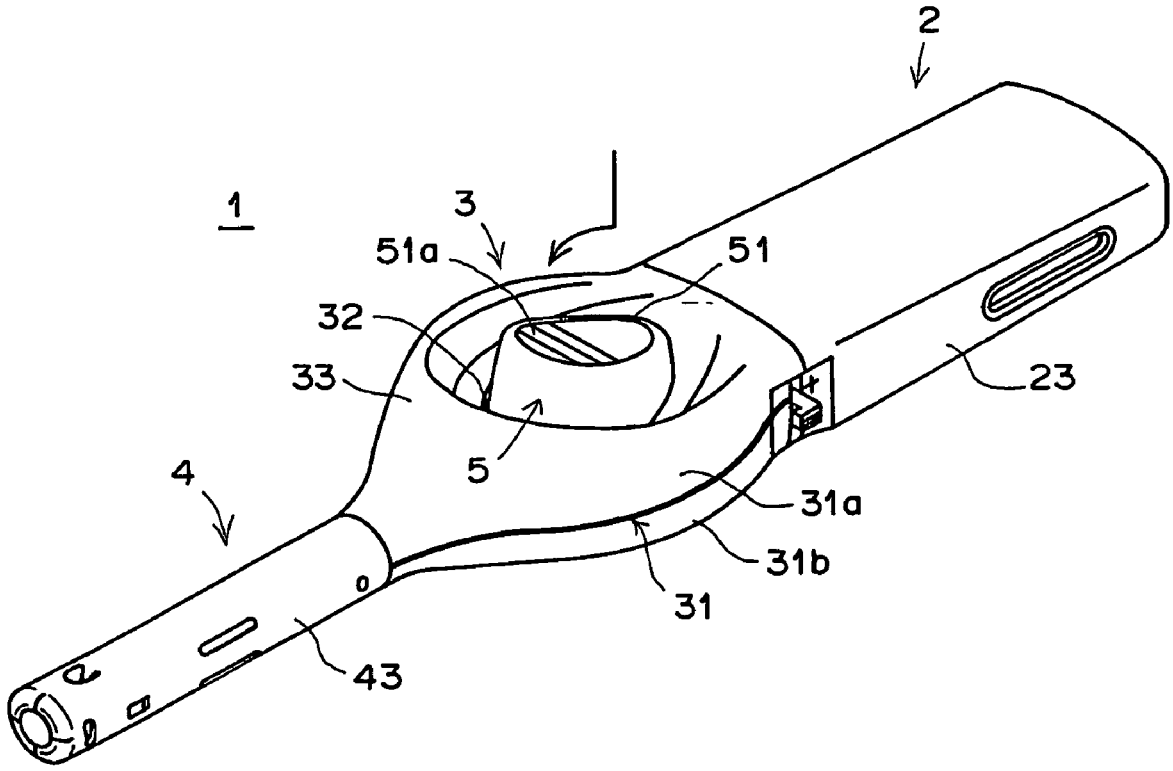
FIG. 1 is a perspective view showing an appearance of an igniter in accordance with a first embodiment of the present invention.
Figure 2:
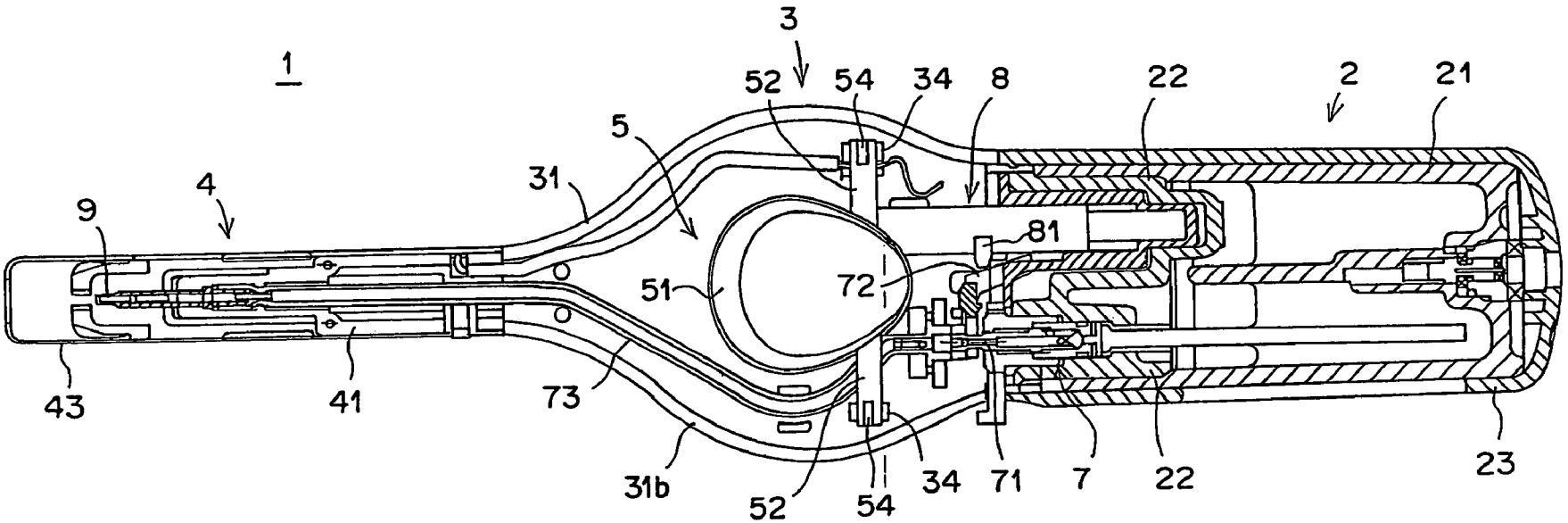
FIG. 2 is a cross-sectional view of the igniter taken along a horizontal medial plane.
Figure 3:
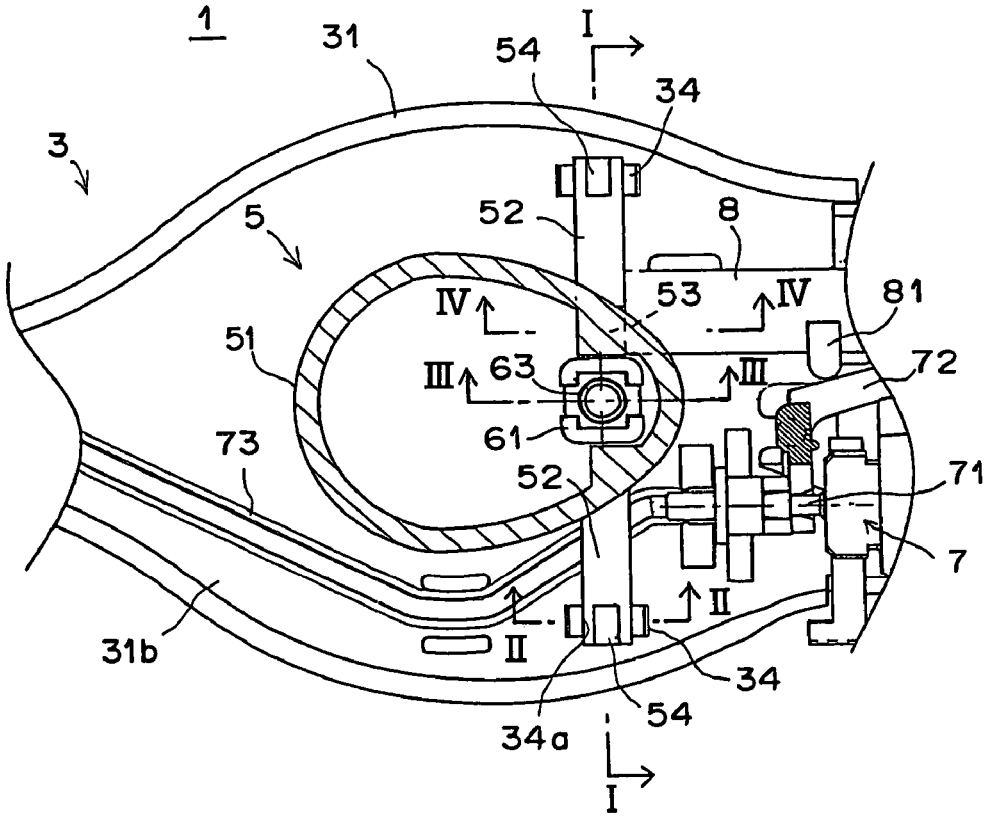
FIG. 3 is a plan view partly in cross-section showing the actuator mechanism of the igniter shown in FIG. 2.

The igniter of this embodiment is in the form of an igniting rod and is shown in FIGS. 1 to 10. FIG. 1 is a perspective view showing an appearance of an igniter in accordance with a first embodiment of the present invention, FIG. 2 is a cross-sectional view of the igniter taken along a horizontal medial plane, FIG. 3 is a plan view partly in cross-section showing the actuator mechanism of the igniter, FIGS. 4 to 7 are cross-sectional views of the parts shown in FIG. 3, and FIGS. 8 to 10 are cross-sectional views for illustrating operation of the igniting rod. In these drawings and the following drawings, hatching showing the cross-sections of the reservoir portion, the valve mechanism and the like is partly abbreviated.

The igniter (igniting rod) 1 of this embodiment comprises, as shown in FIGS. 1 and 2, a reservoir portion 2 which is disposed in a base portion of the igniter 1 and stores therein pressurized fuel gas such as butane gas, an actuator portion 3 which is disposed in an intermediate portion and in which an actuator mechanism 5 for carrying out igniting operation is disposed, and a rod-like portion 4 which extends forward from the actuator portion 3 and is provided with a gas nozzle 9 in the end portion. The actuator mechanism 5 comprises an actuator (actuator button) 51 which is rotated, and a valve mechanism 7 which is interlocked with the actuator mechanism 5 to control supply of gas from the reservoir portion 2 to the gas nozzle 9 in response to operation of the actuator mechanism 5, and a piezoelectric unit 8 which is an ignition mechanism generating a discharge electric voltage for igniting the gas discharged from the gas nozzle 9 and is interlocked with the actuator mechanism 5 to generate the discharge electric voltage in response to operation of the actuator mechanism 5 are provided in the igniter 1.

The reservoir portion 2 comprises a reservoir body 21 which is tubular and has a bottom, a lid member 22 which closes the open end of the reservoir body 21 and a reservoir cover 23 which is disposed to surround the reservoir body 21. The valve mechanism 7 is a known one and is mounted on the lid member 22. The valve mechanism 7 has a nozzle member 71 which opened and closed by an L-shaped lever 72 an end portion of which is engaged with the nozzle member 71. Gas supplied by the valve mechanism 7 is supplied to the gas nozzle 9 in the end portion of the rod-like portion 4 by way of a gas pipe 73.

The actuator portion 3 is provided with an igniter body casing 31 (igniter body) which is horizontally divided into upper and lower halves 31*a* and 31*b*, and an inner tube 41 of the rod-like portion 4 is integrally formed with the front end portion of the igniter body casing 31. The rod-like portion 4 has the gas nozzle 9 connected to the front end of the gas pipe 73 at a central portion of the front end portion of the inner tube 41, and a rod-like metal tubular body 43 is fitted on the outside of the inner tube 41 so that flame is ejected from a flame port which opens in the front end face of the metal tubular body 43. An electrode (not shown) is provided in the metal tubular body 43 to project near to the gas nozzle 9.

A window portion 32 opens in the upper half 31*a* of the igniter body casing 31 and the actuator 51 of the actuator mechanism 5 is disposed at the center of the window portion 32. A protective portion 33 projects from the upper half 31*a* of the igniter body casing 31 along the peripheral edge of the window portion 32. The protective portion 33 is formed to surround the actuator 51 with its front portion higher.

The actuator mechanism 5 comprises the actuator 51 which is rotatable and is provided with an actuating portion 51*a* on its surface, a shaft-like fulcrum member 52 about which the actuator 51 is rotated in a direction perpendicular to the centerline of the valve mechanism 7, an interlocking member 53 (an interlocking lever) which operates the piezoelectric unit 8 in response to rotation of the actuator 51, a lock member 54 which makes an ignition lock, by inhibiting rotation of the actuator 51 and an urging member 6 which urges the actuator 51 toward its locking position.

The piezoelectric unit 8 is disposed between the actuator 51 and the lid member 22 to generate a discharge voltage in response to rotation of the actuator 51, and is provided with a projection 81 on the sliding portion thereof. The projection 81 is brought into abutment against the end portion of the L-shaped lever 72 when the sliding portion is moved rearward upon igniting operation of the actuator mechanism 5 to rotate the L-shaped lever 72, whereby the nozzle member 71 of the valve mechanism 7 is opened and gas is supplied. The discharge voltage generated by the piezoelectric unit 8 is led to the gas nozzle 9 and the electrode in the rod-like portion 4 by way of a known energizing mechanism and an ignition spark is generated therebetween.

The actuator 51 of the actuator mechanism 5 is ellipsoidal in plan and higher in the front portion facing the rod-like portion 4 than the rear portion. That is, the upper surface of the actuator 51 forming the actuating portion 51*a* is inclined to be higher forward, and when the igniter 1 is to be ignited, i.e., for igniting operation, a user's finger is applied to the actuating portion 51*a* and the actuating portion 51*a* is pushed forward. The igniting operation of the actuator 51 involves rotation of the actuator 51 about the fulcrum member 52 and an auxiliary operation of the same in a direction different from the direction of rotation to be done in continuous with rotation of the actuator. In this particular embodiment, the auxiliary operation of the actuator 51 is downward depression of the rear portion of the actuator 51.

Figure 4:
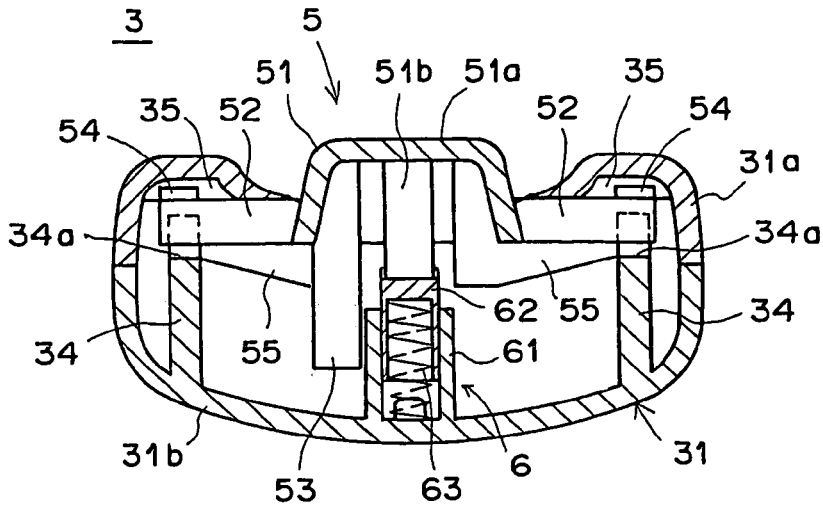
FIG. 4 is a cross-sectional view taken along line I-I in FIG. 3.
Figure 5:
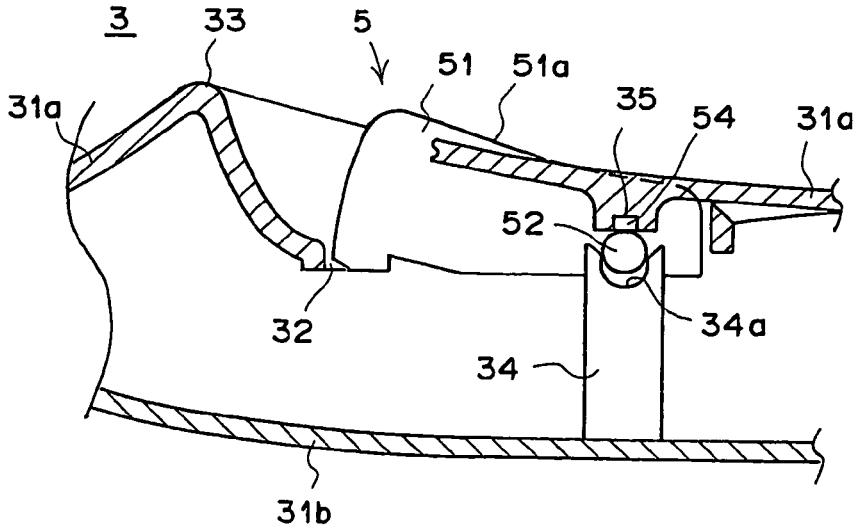
FIG. 5 is a cross-sectional view taken along line II-II in FIG. 3.

As shown in FIGS. 3 to 5, the base end of the fulcrum member (rotary shaft) 52 which is like a laterally extending round rod is fixed to the lower portion of the actuator member 51 near to the reservoir portion 2 on opposite sides of the actuator 51 and a pair of bearing portions 34 are erected on the bottom of the lower half 31*b* of the igniter body casing 31 on opposite sides of the bottom of the lower half 31*b*. A bearing groove 34*a* (FIG. 5) is formed in the top end of each of the bearing portions 34 to be vertically long. The fulcrum member 52 is received in the bearing grooves 34*a* of the bearing portions 34, whereby the actuator 51 is supported on the fulcrum member 52 so that the front end portion thereof is rotatable and the rear end portion thereof is movable up and down.

In this particular embodiment, lock members 54 which inhibit rotation of the actuator 51 to disable ignition of the igniter 1 by preventing revolution of the fulcrum member 52 are provided. That is, the fulcrum member 52 is provided with a lock member 54 (engagement projection) in the form of a projection on the upper portion of each of opposite end portions thereof. The lock members 54 are adapted to be engaged with a groove-like engagement portions 35*a* formed on the lower surface of the upper half 31*a* of the igniter body casing 31. When the lock members 54 are engaged with the groove-like engagement portions 35, revolution of the fulcrum member 52, that is, rotation of the actuator 51, is inhibited, whereby the igniter 1 is brought into the locked state. The auxiliary operation to release the lock of the igniter 1 is carried out by depressing the rear end portion of the actuator 51 to move downward the fulcrum member 52 so that the lock members 54 are disengaged from the engagement portions 35 and rotation of the actuator 51 is permitted. Though, in the illustrated embodiment, the lock member 54 is a rectangular projection and the engagement portion 35 is in the form of a recessed groove, the lock member 54 may be like a pin with the engagement portion 35 like hole. Further, inversely to the case described above, a projecting lock member may be formed on the lower surface of the upper half 31*a* of the igniter body casing and a recessed engagement portion may be formed on the fulcrum member 52.

Figure 6:
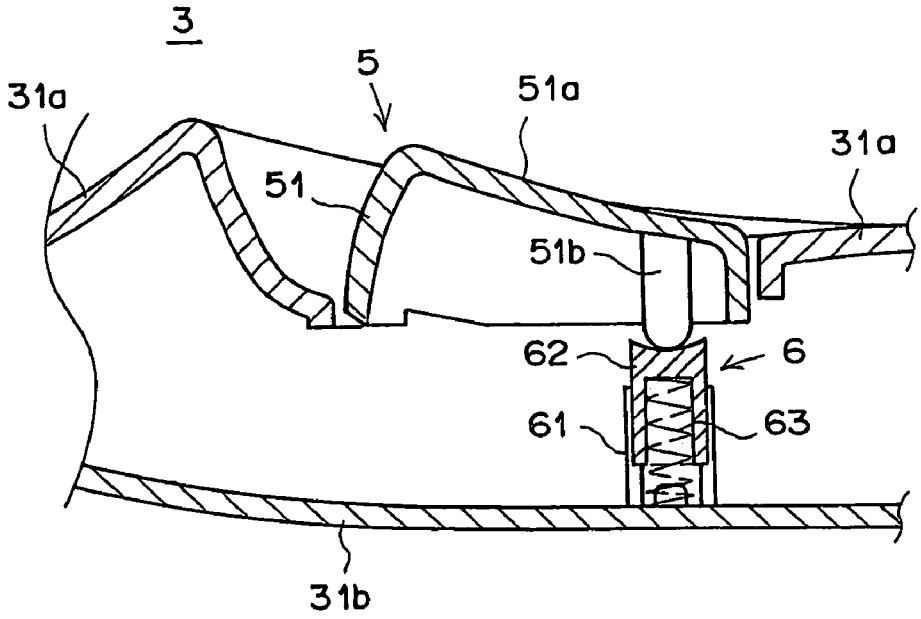
FIG. 6 is a cross-sectional view taken along line III-III in FIG. 3.

As shown in FIG. 6, the actuator 51 is provided with a downward extending projection 51*b* on its lower surface near the center of the fulcrum member 52 and the projection 51*b* is urged upward by the urging member 6. The urging member 6 is provided with a pressing member 62 which is slidable up and down in a guide portion 61 formed on the bottom of the lower half 31*b* of the igniter body casing 31, and a coiled spring 63 is compressed by the pressing member 62, whereby the pressing member 62 is urged upward by the coiled spring 63. The top surface of the pressing member 62 is formed in a concave arcuate surface and the lower end of the projection 51*b* formed in a convex arcuate surface is in abutment against the top surface of the pressing member 62, whereby the lower end of the projection 51*b* and the top surface of the pressing member 62 are in contact with each other to be slidable relatively to each other even if the actuator 51 has been rotated and the rear end portion of the actuator 51 and the fulcrum member 52 are urged upward to the lock position.

Figure 7:
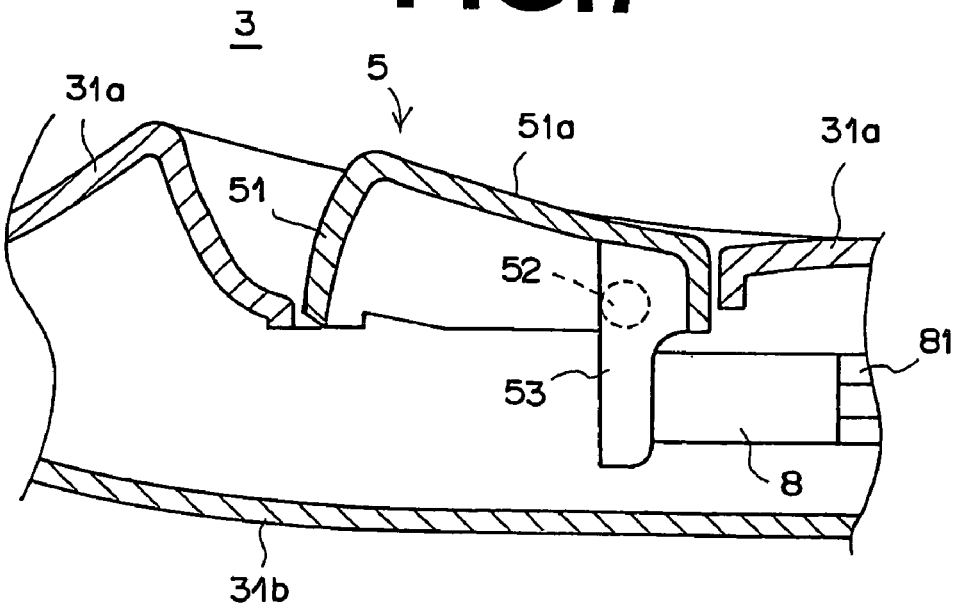
FIG. 7 is a cross-sectional view taken along line IV-IV in FIG. 3.

Further, as shown in FIG. 7, the actuator 51 is provided with an interlocking member 53 extending downward from a rear end portion of the actuator 51. The front end of the piezoelectric unit 8 abuts against the lower rear end of the interlocking member 53 so that the piezoelectric unit 8 is moved rearward by the interlocking member 53 in response to rotation of the actuator 51. The return spring (not shown) built in the piezoelectric unit 8 urges the interlocking member 53 toward its initial position, whereby the front end portion of the actuator 51 is urged to rotate upward.

As shown in FIG. 4, a reinforcing rib 55 extending from the actuator 51 to the lower end of the fulcrum member 52 on opposite sides of the actuator 51 reinforces the fulcrum member 52.

Operation of the igniter 1 of this embodiment will be described, hereinbelow. That is, when the igniter 1 is in its non-operated state (left to stand still) where the actuator 51 is not operated as shown in FIGS. 1 to 7, the actuator 51 and the fulcrum member 52 are held in their lifted positions under the force of the urging member 6, and the lock members 54 are in engagement with the engagement portions 35. In this state, the actuator 51 cannot be rotated since rotation of the fulcrum member 52 is inhibited. That is, the igniter 1 is locked.

Figure 8:
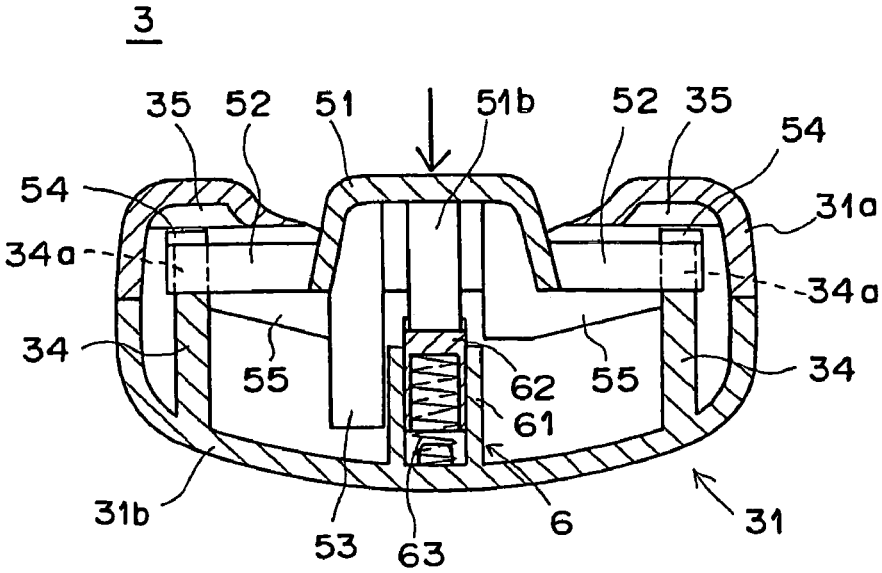
FIG. 8 is a front view partly in cross-section showing an important part shown in FIG. 4 but in a lock release state.
Figure 9:
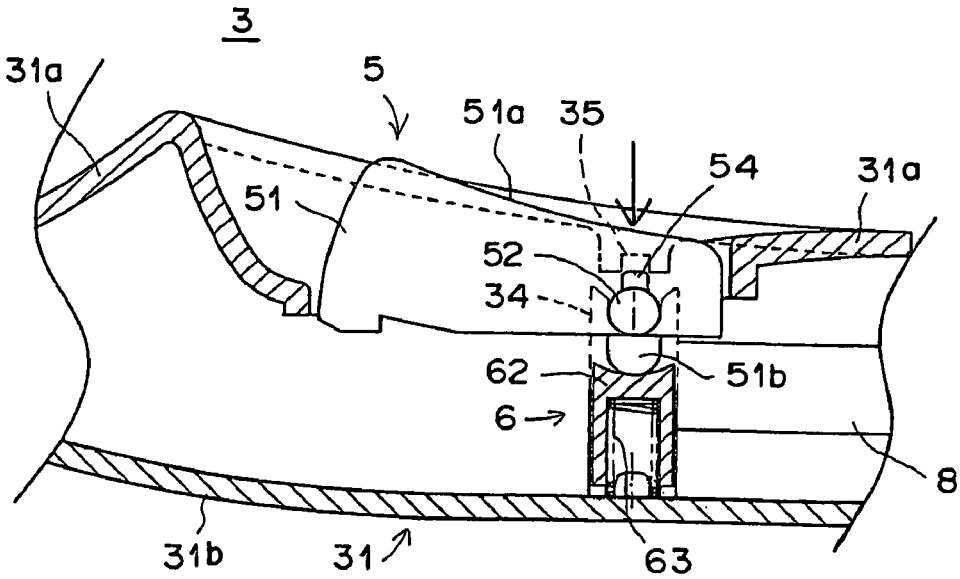
FIG. 9 is a side view partly in cross-section showing an important part shown in FIG. 5 but in a lock release state.

When the igniter 1 is to be ignited, auxiliary operation is done. That is, a finger is applied to the actuating portion 51*a* of the actuator 51, and the rear end portion of the actuator 51 is depressed in the direction of the arrow overcoming the force of the urging member 6 as shown in FIGS. 8 and 9. By the auxiliary operation, the fulcrum member 52 is moved downward and the lock members 54 are disengaged from the engagement portions 35, whereby the igniter 1 is turned to the lock release state, where rotation of the actuator 51 is permitted.

Figure 10:
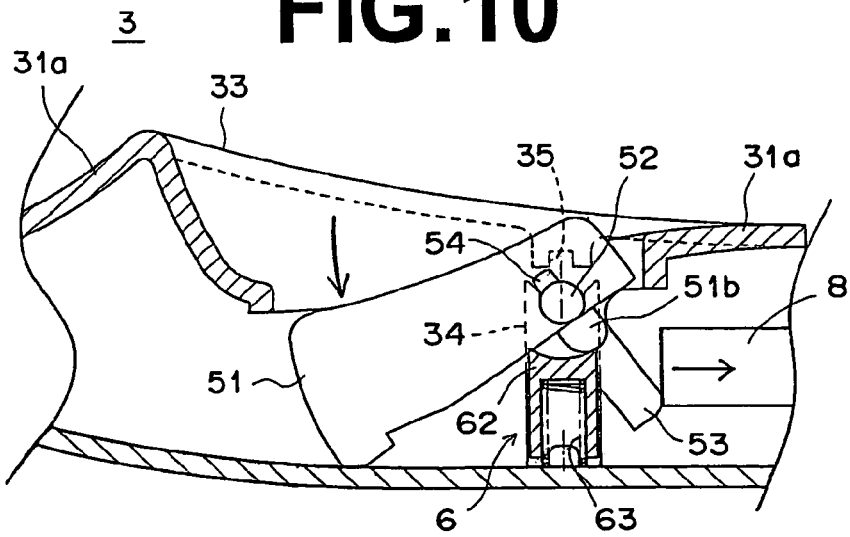
FIG. 10 is a side view partly in cross-section showing the important part shown in FIG. 9 for illustrating ignition from the state shown in FIG. 9.

When the front end portion of the actuator 51 is depressed in the direction of the arrow in FIG. 10 to rotate the actuator 51 with the rear end portion of the actuator 51 held in the depressed state by the auxiliary operation, the interlocking member 53 moves rearward the piezoelectric unit 8 so that the projection 81 rotates the lever 72, whereby the nozzle member 71 is lifted to open the valve mechanism 7 and gas is supplied to the gas nozzle 9 through the gas pipe 73. Further, a discharge voltage is generated in response to operation of the piezoelectric unit 8 and an electric spark is generated between the electrode in the rod-like portion 4 and the gas nozzle 9, whereby the discharged gas is ignited.

When depression of the actuator 51 is released or the finger which has been applied to the actuating portion 51*a* is released for interrupting use of the igniter 1, the actuator 51 is rotated in the reverse direction to return to the initial position by way of the interlocking member 53 under the force of the return spring (not shown) in the piezoelectric unit 8 and at the same time, the fulcrum member 52 is rotated in the reverse direction to the position where the lock members 54 and the engagement portions 35 can be engaged with each other and the fulcrum member 52 is lifted under the force of the urging member 6 so that the lock members 54 and the engagement portions 35 are engaged with each other, whereby the igniter 1 is automatically returned to the locked state.

Though, in the above embodiment, the fulcrum member 52 is fixed to the actuator 51, the fulcrum member 52 may be mounted on the igniter body casing 31 to support the actuator 51 for rotation and up-and-down movement. In this case, the fulcrum member 52 is fixed to be neither rotated nor moved up and down while supporting the actuator 51 to be movable up and down by way of, for instance, an elongated hole, and the lock member 54 is disposed between the fulcrum member 52 and the actuator 51 so that the lock member 54 is disengaged in response to an auxiliary operation of depressing the actuator 51 to move downward the same.

Further, the urging member 6 may be arranged to urge the fulcrum member 52. For example, an urging member 6 which urges upward the end portion of the fulcrum member 52 may be provided on the bearing portion 34.

Further, the igniting mechanism for generating a discharge voltage may comprise a discharge circuit using a cell in place of the piezoelectric unit 8. This is the same in all the embodiments to be described later.

In accordance with this embodiment, it is necessary to perform, prior to rotation of the actuator 51, an auxiliary operation of lock release by depressing the rear end portion of the actuator 51 in a direction different from the direction in which the actuator 51 is rotated. In an unused state, the lock members 54 and the engagement portions 35 are constantly engaged with each other to disable the igniter 1 from being ignited, and after use of the igniter 1, the igniter 1 is automatically returned to the locked state. Accordingly, inadvertent ignition of the igniter can be prevented, and at the same time, the auxiliary operation of lock release and rotation of the actuator for ignition can be smoothly carried out, whereby good operability can be obtained.

Second Embodiment

Figure 11:
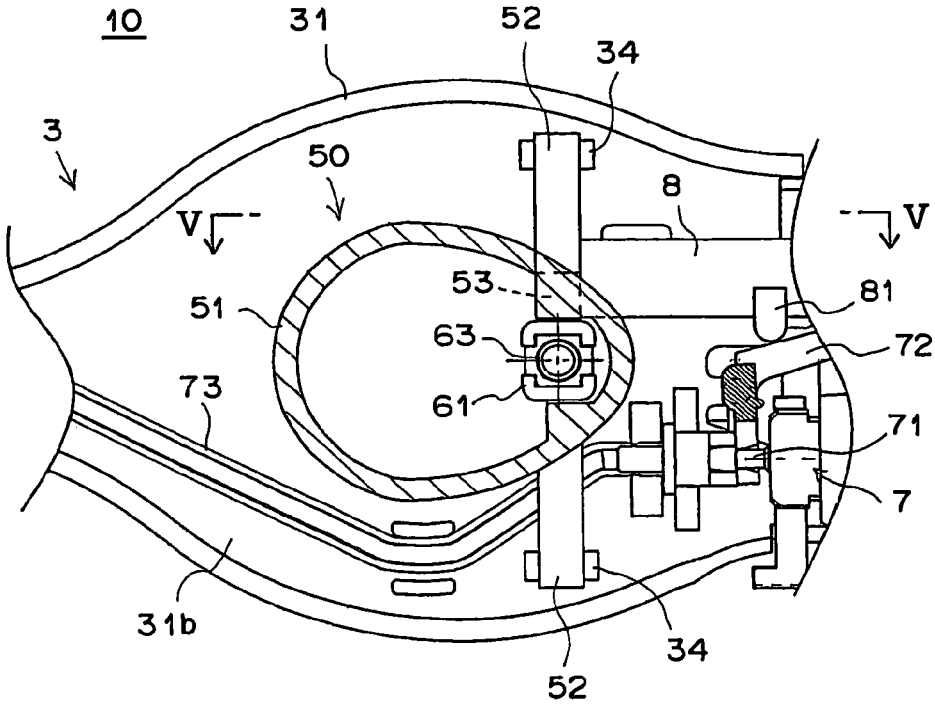
FIG. 11 is a plan view partly in cross-section showing the actuator mechanism of an igniter in accordance with a second embodiment of the present invention.
Figure 12:
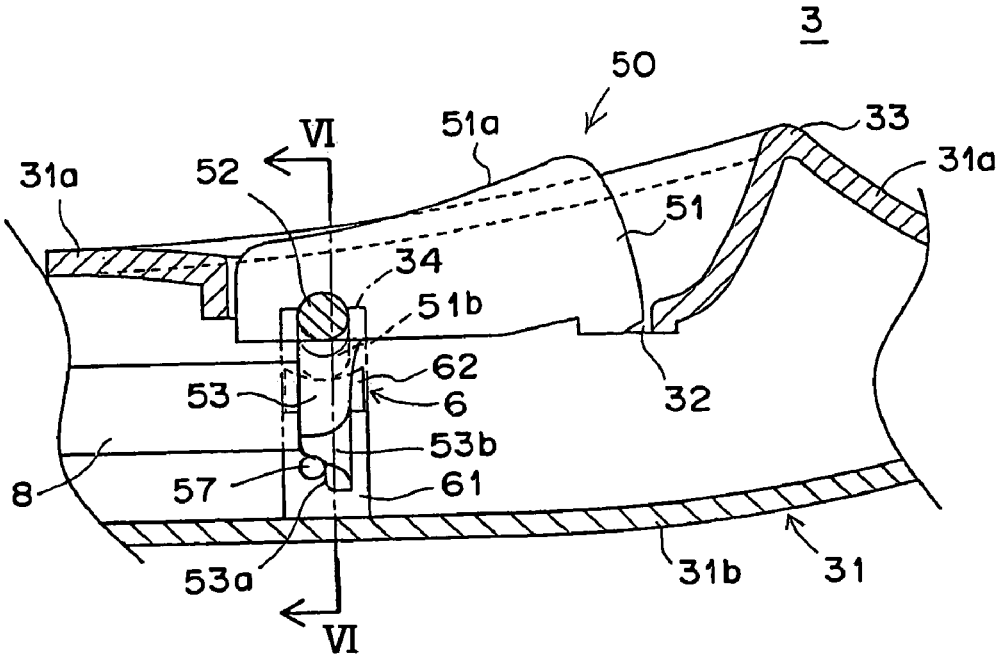
FIG. 12 is a cross-sectional view taken along line V-V in FIG. 11.
Figure 13:
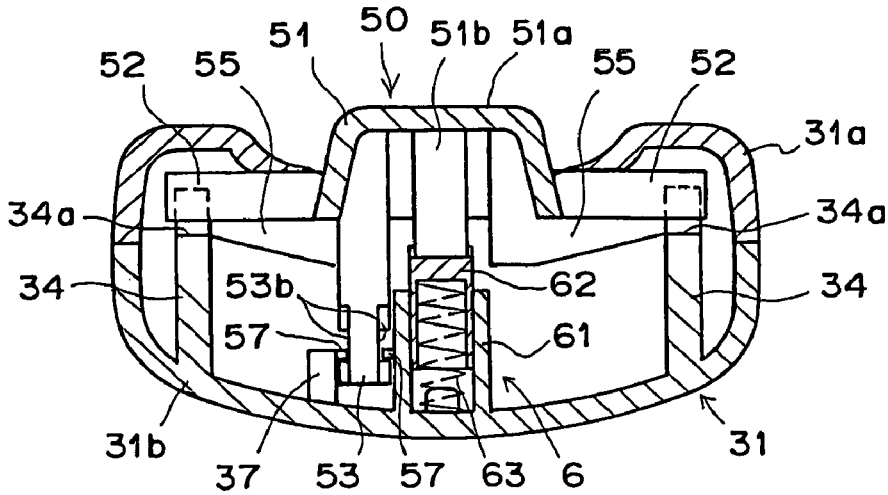
FIG. 13 is a cross-sectional view taken along line VI-VI in FIG. 12.
Figure 14:
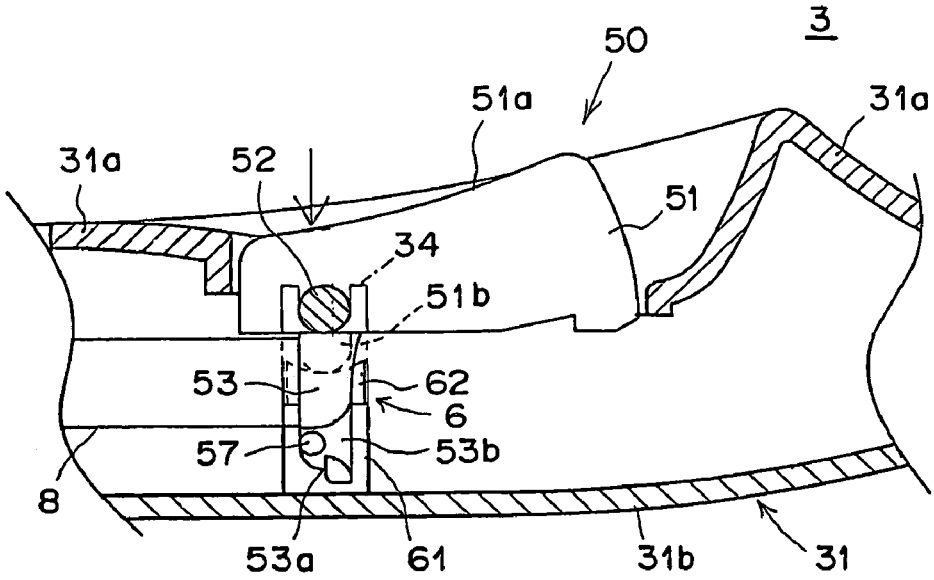
FIG. 14 is a front view partly in cross-section showing an important part shown in FIG. 12 but in a lock release state.

An igniter in accordance with another embodiment of the present invention is shown in FIGS. 11 to 17. FIG. 11 is a plan view partly in cross-section showing the actuator mechanism of the igniter, FIGS. 12 to 14 are cross-sectional views of the parts shown in FIG. 11, and FIGS. 15 to 17 are cross-sectional views for illustrating operation of the igniting rod.

The igniter (igniting rod) 10 of this embodiment is the same as the first embodiment except the actuator mechanism 50, and accordingly, the analogous elements are given the same reference numerals.

The actuator mechanism 50 of the igniter of this embodiment comprises an actuator 51 similar to that of the first embodiment, and the actuator 51 is held by a fulcrum member 52 on its opposite sides to be rotatable and movable up and down. The actuator 51 has on its rear end portion an interlocking member 53 which extends downward and actuates the piezoelectric unit 8. Further the rear end portion of the actuator 51 is urged upward or toward its lock position by an urging member 6 which is of the same structure as that of the first embodiment. The igniting operation of the actuator 51 involves rotation of the actuator 51 about the fulcrum member 52 and an auxiliary operation of the same in a direction different from the direction of rotation to be done in continuous with rotation of the actuator. In this particular embodiment, the auxiliary operation of the actuator 51 is downward depression of the rear portion of the actuator 51.

Lock members 57 for carrying out the ignition lock by inhibiting rotation of the actuator 51 are provided to inhibit movement of the interlocking member 53. That is, a bracket 37 is erected on the bottom of the lower half 31*b* of the igniter body casing 31 on a side of the interlocking member 53, and the bracket 37 has one of the lock members 57 (engagement projection) on its side surface facing the interlocking member 53. Further, the urging member 6 has another of the lock members 57 on the side surface of a frame-like guide portion 61 thereof facing the interlocking member 53.

Each of the lock members 57 is a pin-like projection which is adapted to be engaged with the rear end of an engagement portion 53*a* formed on the end of the interlocking member 53. When the lock member 57 is engaged with the engagement portion 53*a*, rotation of the interlocking member 53, that is, rotation of the actuator 51, is inhibited and the igniter is brought into the locked state. The auxiliary operation to release the lock is to depress the rear end portion of the actuator 51 to move downward the interlocking member 53 so that the lock member 57 is disengaged from the engagement member 53*a* and moved into a groove 53*b* formed in the side of the interlocking member 53, thereby permitting rotation of the actuator 51.

The groove 53*b* is formed arcuately about the fulcrum member 52 to extend from the front end portion to the rear end portion of the interlocking member 53. Further, the engagement portion 53*a* on the lower end of the groove 53*b* is cut away on the side facing the rear end of the groove 53*b* and the upper portion of the lock member 57 faces the rear end of the groove 53*b* in the engaged state shown in FIG. 12. Further, the front end portions of the grooves 53*b* are tapered in the vertical direction to guide the lock members 57 upon returning to the initial position.

Though, in the illustrated embodiment, the pin-like lock members 57 are provided on the bracket 37 and the guide portion 61, and the engagement portions 53*a* and the grooves 53 are provided on the interlocking member 53, the engagement portions 53*a* and the grooves 53 may be provided on the bracket 37 and the guide portion 61, and the pin-like lock members 57 may be provided on the interlocking member 53, inversely to the illustrated embodiment. Further, though, in the illustrated embodiment, the lock member 57 is provided on each side of the interlocking member 53, the lock member 57 may be provided on one side of the interlocking member 53.

In this embodiment, when the igniter 1 is in its non-operated state (left to stand still) where the actuator 51 is not operated as shown in FIGS. 12 and 13, the actuator 51 and the interlocking member 53 are held in their lifted positions under the force of the urging member 6, and the lock members 57 are in engagement with the engagement portions 53*a*. In this state, the actuator 51 cannot be rotated since rotation of the interlocking member 53 is inhibited. That is, the igniter 1 is locked.

Figure 15:
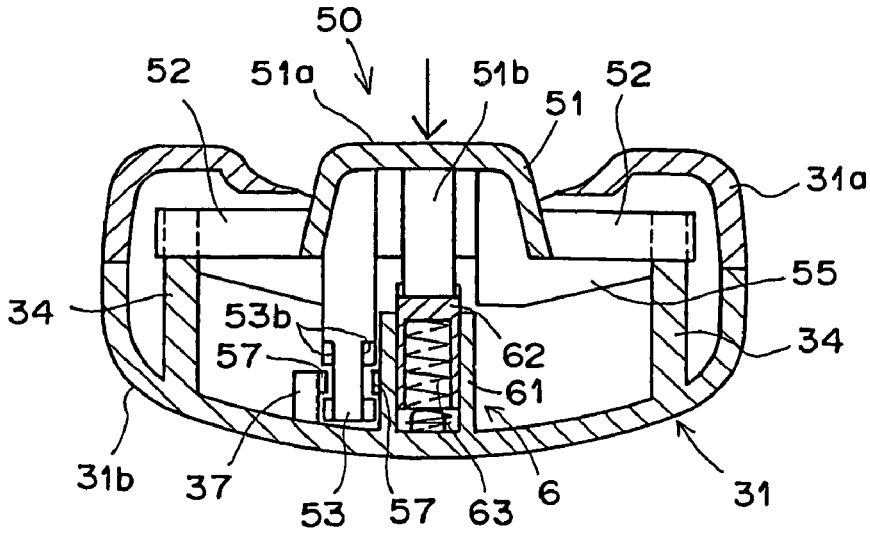
FIG. 15 is a front view partly in cross-section showing an important part shown in FIG. 13 but in a lock release state.

When the igniter 1 is to be ignited, auxiliary operation is done. That is, a finger is applied to the actuating portion 51*a* of the actuator 51, and the rear end portion of the actuator 51 is depressed in the direction of the arrow overcoming the force of the urging member 6 as shown in FIGS. 14 and 15. By the auxiliary operation, the interlocking member 53 is moved downward and the lock members 57 are disengaged from the engagement portions 53*a* into the grooves 53*b*, whereby the igniter 1 is turned to the lock release state, where rotation of the actuator 51 is permitted.

Figure 16:
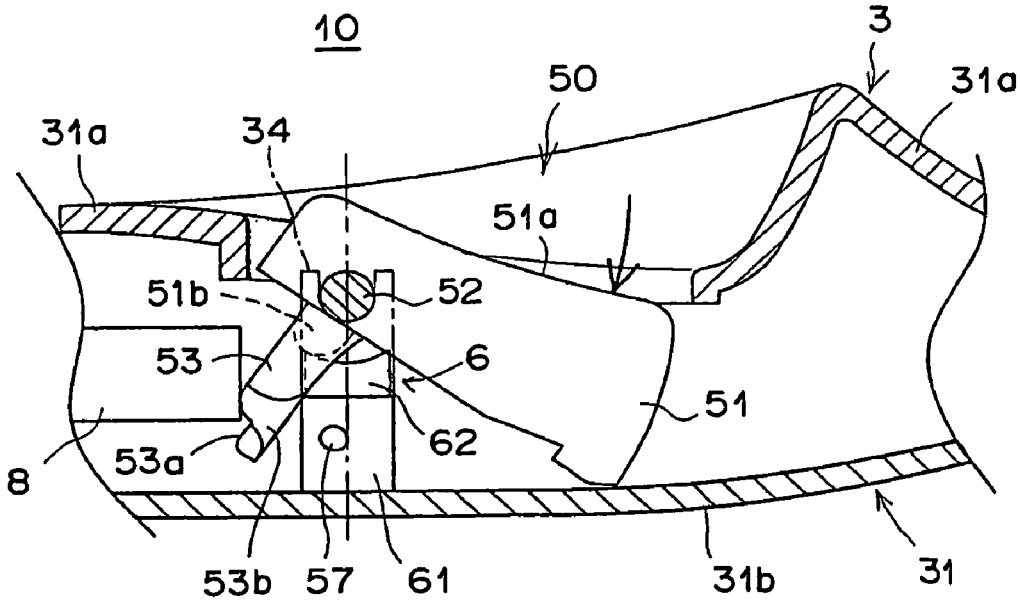
FIG. 16 is a side view partly in cross-section showing the important part shown in FIG. 14 for illustrating ignition from the state shown in FIG. 14.
Figure 17:
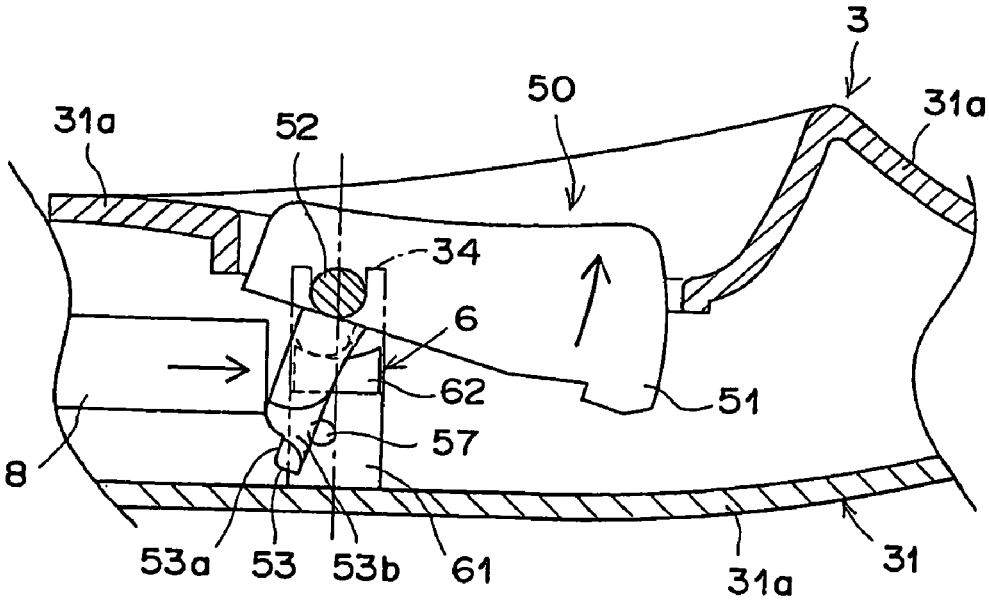
FIG. 17 is a side view partly in cross-section showing the important part shown in FIG. 16 but illustrating return to the initial state from the state shown in FIG. 16.

When the front end portion of the actuator 51 is depressed in the direction of the arrow in FIG. 16 to rotate the actuator 51 with the rear end portion of the actuator 51 held in the depressed state by the auxiliary operation, the interlocking member 53 rotates with the lock members 57 moved through the grooves 53*b* to move rearward the piezoelectric unit 8, whereby the nozzle member 71 is lifted to open the valve mechanism 7 and gas is supplied to the gas nozzle 9 through the gas pipe 73. Further, the discharged gas is ignited by the electric voltage discharge.

When depression of the actuator 51 is released to interrupt use of the igniter 1, the interlocking member 53 and the actuator 51 are rotated in the reverse direction to return to the initial position under the force of the return spring in the piezoelectric unit 8. At this time, the lock member 57 is passed through the groove 53*b* of the interlocking member 53 from the front end portion to the rear end portion and returns to the initial position. Thereafter the interlocking member 53 is lifted under the force of the urging member 6 so that the lock members 57 and the engagement portions 53*a* are engaged with each other, whereby the igniter 1 is automatically returned to the locked state. When the actuator 51 is released from the finger and the interlocking member 53 is lifted upward under the force of the urging member 6 before the actuator 51 is rotated back to the initial position, the lock member 57 is returned to the initial position under the guidance of the front side curved surface of the groove 53*b*.

Also, in accordance with this embodiment, desired lock function and lock release function are obtained and at the same time, an automatic return of the igniter to the locked state can be obtained. Further, the operability of the igniter is excellent.

The auxiliary operation of the actuator (the lock release operation) need not be limited to those in the preceding embodiments but may be performed in any direction so long as it is different from the direction of rotation of the actuator. For example, the auxiliary operation of the actuator may be performed back and forth or left and right other than up and down. The lock member may be arranged to engage and disengage according to the direction of the auxiliary operation.

Third Embodiment

Figure 18:
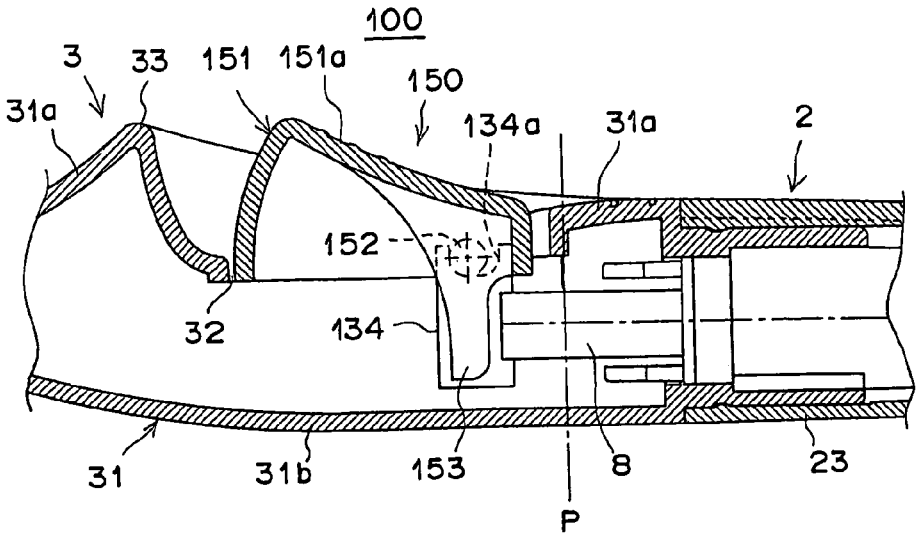
FIG. 18 is a side view partly in cross-section showing the actuator mechanism of an igniter in accordance with a third embodiment of the present invention in its non-operated state.
Figure 19:
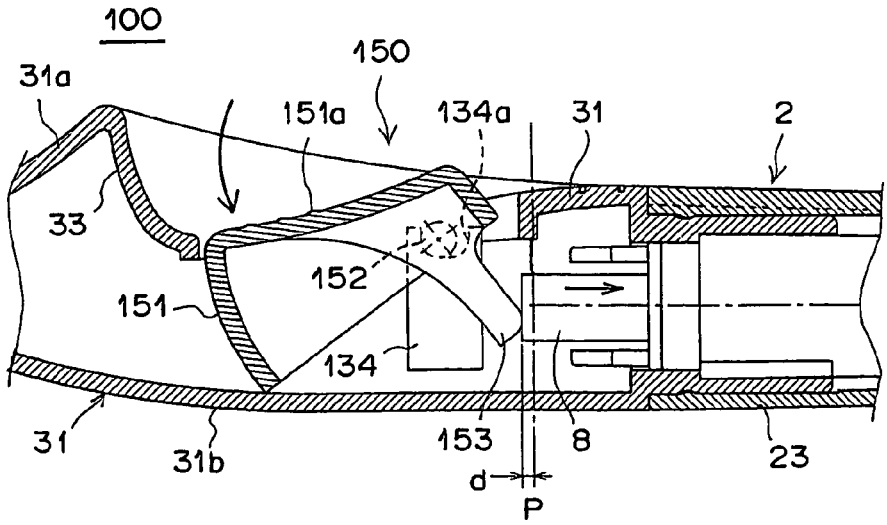
FIG. 19 is a side view partly in cross-section showing the actuator mechanism of the igniter shown in FIG. 18 for illustrating rotation of the actuator.
Figure 20:
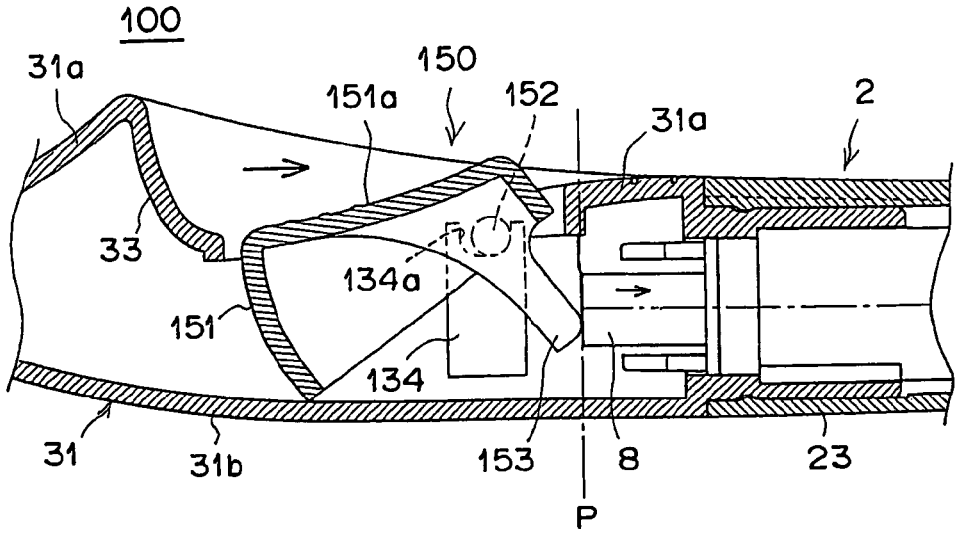
FIG. 20 is a side view partly in cross-section showing the actuator mechanism of the igniter in a state where the auxiliary operation has been further done from the state shown in FIG. 19.

FIGS. 18 to 20 show an igniter in accordance with another embodiment of the present invention. FIG. 18 is a side view partly in cross-section showing the actuator mechanism in its non-operated state, FIG. 19 is a side view partly in cross-section showing the actuator mechanism shown in FIG. 18 for illustrating rotation of the actuator, and FIG. 20 is a side view partly in cross-section showing the actuator mechanism in a state where the auxiliary operation has been further done from the state shown in FIG. 19.

The igniter (igniting rod) 100 of this embodiment is the same as the first embodiment except the actuator mechanism 150, and accordingly, the analogous elements are given the same reference numerals.

The actuator mechanism 150 of the igniter of this embodiment comprises an actuator 151 similar to that of the first embodiment in appearance and provided with an actuating portion 151*a* on its surface, and the actuator 151 is held by a fulcrum member 152 on its opposite sides for rotation and back-and-forth movement on the top ends of bearing portions 134. The actuator 151 has on its rear end portion an interlocking member 153 which extends downward and actuates the piezoelectric unit 8. That is, the base end of the fulcrum member (rotary shaft) 152 which is like a laterally extending round rod is fixed to the lower portion of the actuator member 151 near to the reservoir portion 2 on opposite sides of the actuator 151 and a pair of bearing portions 134 are erected on the bottom of the lower half 31*b* of the igniter body casing 31 on opposite sides of the bottom of the lower half 31*b*. A bearing groove 134*a* is formed in the top end of each of the bearing portions 134 to be vertically long. The fulcrum member 152 is received in the bearing grooves 134*a* of the bearing portions 134, whereby the actuator 151 is supported on the fulcrum member 152 so that the front end portion thereof is rotatable and the whole actuator 151 is movable back and forth in parallel to the direction of operation of the piezoelectric unit 8.

The igniting operation of the actuator 151 involves rotation of the actuator 151 about the fulcrum member 152 and an auxiliary operation of the same in a direction different from the direction of rotation to be done in continuous with rotation of the actuator 151. In this particular embodiment, the auxiliary operation of the actuator 151 is rearward movement of the whole actuator 151 in parallel to the direction of operation of the piezoelectric unit 8. The piezoelectric unit 8 discharges a discharge voltage when its front end is moved rearward to a discharge position P.

The actuator 151 is arranged so that the fulcrum member 152 is positioned in the forward position in the bearing groove 134*a* of the bearing portion 134 as shown in FIG. 18 in the non-operated state or the returned state and a maximum rotation of the actuator 151 in this state causes the interlocking member 153 to operate the piezoelectric unit 8 by an amount smaller than the amount of operation to the discharge position P by an amount d as shown in FIG. 19. That is, the piezoelectric unit 8 can discharge no electric voltage in this state.

The amount of movement of the auxiliary operation to move the fulcrum member 152 to the rearward position in the bearing groove 134*a* of the bearing portion 134 is larger than the amount d so that, in addition to rotation of the actuator 151, auxiliary operation of the actuator 151 in the rearward direction shown by the arrow different from the direction of rotation of the actuator 151 can cause the interlocking member 153 to operate the piezoelectric unit 8 to the discharge position P as shown in FIG. 20. That is, the piezoelectric unit 8 can generate a discharge voltage.

In this embodiment, unless the auxiliary operation of the actuator 151, the fulcrum member 152 is positioned in the forward position in the bearing groove 134*a* of the bearing portion 134 as shown in FIG. 18 and a rotation of the actuator 151 in this state causes the interlocking member 153 to operate the piezoelectric unit 8 by an amount smaller than the amount of operation to the discharge position P by an amount d as shown in FIG. 19. That is, the igniter is disabled from ignition. When the auxiliary operation to move rearward the actuator 151 as shown by the arrow in FIG. 20 is carried out in addition to rotation of the actuator 151, the interlocking member 153 comes to be able to operate the piezoelectric unit 8 to the discharge position P as shown in FIG. 20. That is, the piezoelectric unit 8 can generate a discharge voltage to ignite gas discharged from the gas nozzle. The auxiliary operation may be carried out prior to rotation of the actuator 151.

When rotation and auxiliary operation of the actuator 151 is released to interrupt use of the igniter, the interlocking member 153 and the actuator 151 are rotated in the reverse direction and are moved forth to return to the initial position shown in FIG. 18 under the force of the return spring in the piezoelectric unit 8. That is, the igniter is automatically returned to a state where ignition of the igniter is disabled.

Also, in accordance with this embodiment, ignition lock to prevent the igniter from being ignited by simple rotation of the actuator 151 can be ensured and the ignition lock can be released in a series of actions and at the same time, an automatic return of the igniter to the locked state can be obtained. Further, the operability of the igniter is excellent.

Fourth Embodiment

Figure 21:
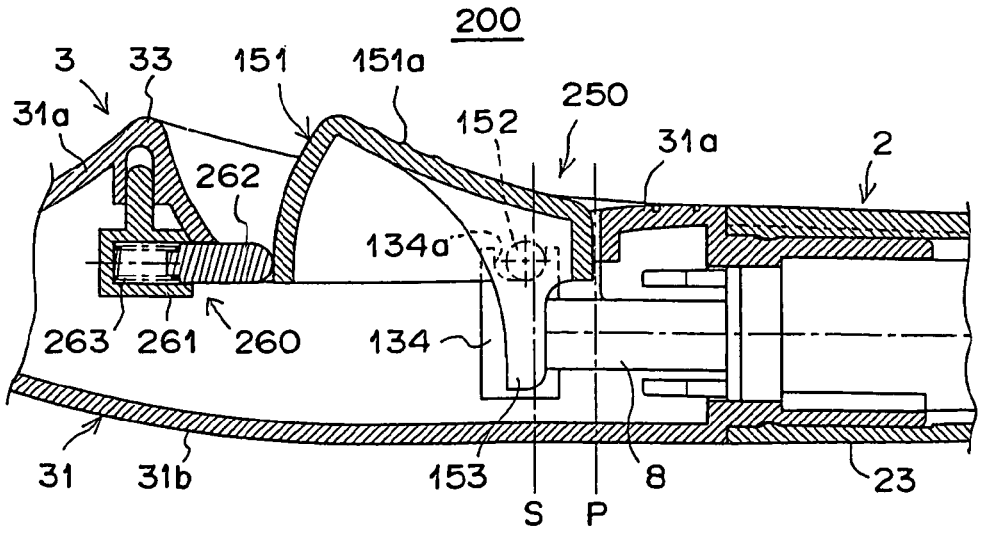
FIG. 21 is a side view partly in cross-section showing the actuator mechanism of an igniter in accordance with a fourth embodiment of the present invention in its non-operated state.
Figure 22:
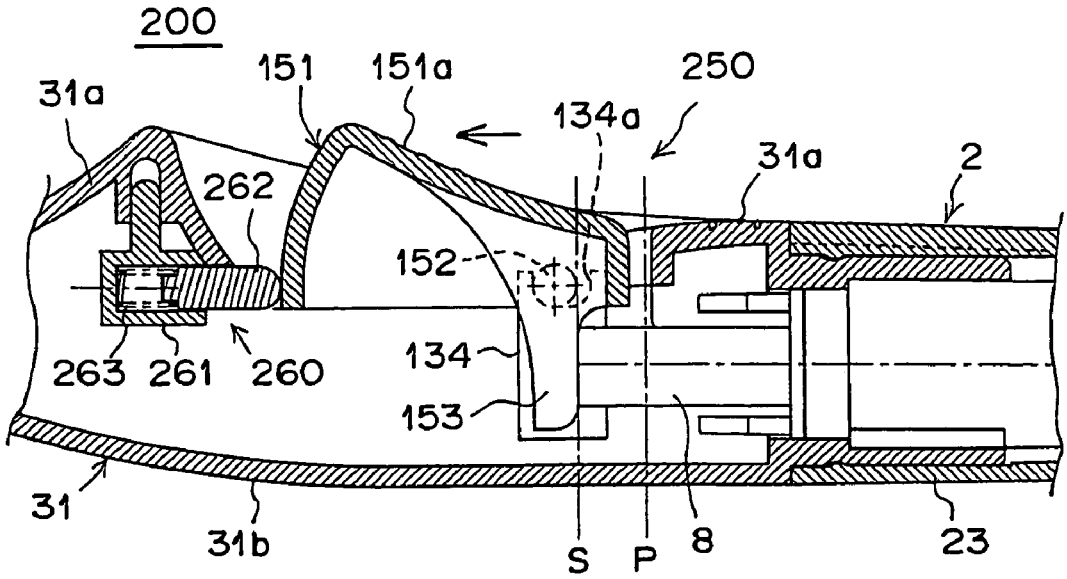
FIG. 22 is a side view partly in cross-section showing the actuator mechanism of the igniter shown in FIG. 21 for illustrating the auxiliary operation.
Figure 23:
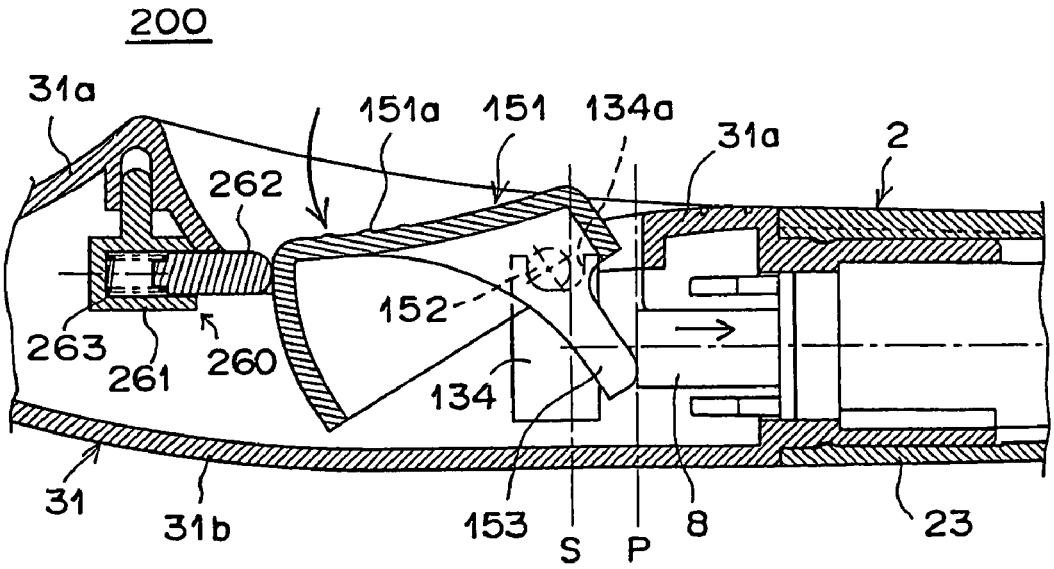
FIG. 23 is a side view partly in cross-section showing the actuator mechanism of the igniter in a state where rotation of the actuator has been further done from the state shown in FIG. 22.

FIGS. 21 to 23 show an igniter in accordance with another embodiment of the present invention. FIG. 21 is a side view partly in cross-section showing the actuator mechanism in its non-operated state, FIG. 22 is a side view partly in cross-section showing the actuator mechanism shown in FIG. 21 after the auxiliary operation has been done, and FIG. 23 is a side view partly in cross-section showing the actuator mechanism in a state where the actuator has been rotated from the state shown in FIG. 22.

The igniter (igniting rod) 200 of this embodiment is the same as the preceding embodiment except the actuator mechanism 250, and accordingly, the analogous elements are given the same reference numerals.

The actuator mechanism 250 of the igniter of this embodiment comprises an actuator 151 similar to that of the third embodiment, and the actuator 151 is held by a fulcrum member 152 on its opposite sides for rotation and back-and-forth movement along bearing grooves 134*a* formed in the top ends of the bearing portions 134 to be long back and forth in parallel to the direction of operation of the piezoelectric unit 8. The actuator 153 has an interlocking member 153 which extends downward to operate the piezoelectric unit 8 on its rearward portion.

In this particular embodiment, the igniting operation of the actuator 151 involves rotation of the actuator 151 about the fulcrum member 152 and an auxiliary operation of the same in a direction different from the direction of rotation to be done in continuous with rotation of the actuator 151. In this particular embodiment, the auxiliary operation of the actuator 151 is forward movement of the whole actuator 151 in the direction reverse to the direction of operation of the piezoelectric unit 8. The piezoelectric unit 8 discharges an electric voltage when the front end is moved rearward to the discharge position P and when the front end is returned to the reset position S, the piezoelectric unit 8 comes to be able to discharge again.

The actuator mechanism 250 is provided with a reset prevention member 260 which prevents the piezoelectric unit 8 from being moved forward up to the reset position S. The reset prevention member 260 comprises a pressing member 262 which slides back and forth in a guide portion 161 provided on a protective portion 33 of the upper half 31*a* of the igniter body casing 31 forward of the actuator 151, and the pressing member 262 is urged rearward by a coiled spring 263 (may be resilient material such as a leaf spring, a resin spring or the like). The rear end of the pressing member 262 constantly abuts against the front end of the actuator 151 even if the actuator 151 is rotated to urge rearward the actuator 151 so that the piezoelectric unit 8 cannot be fully returned to the initial position.

In the non-operated state or the returned state from the preceding igniting action shown in FIG. 21, the reset prevention member 260 urges rearward the piezoelectric unit 8 by way of the actuator 151 and the interlocking member 153 so that the piezoelectric unit 8 stops short of the reset position S. That is, the reset prevention member 260 prevents movement of the fulcrum member 152 to the rearward position in the bearing groove 134*a* until the auxiliary operation of the actuator 151 is done. In the non-operated state, the piezoelectric unit 8 cannot be reset and rotation of the actuator 151 from this position cannot cause the piezoelectric unit 8 to discharge an electric voltage even if the piezoelectric unit 8 is operated to the discharge position P.

The amount of movement of the auxiliary operation to move the fulcrum member 152 to the forward position in the bearing groove 134*a* of the bearing portion 134 is to permit the piezoelectric unit 8 to return to the reset position S so that auxiliary operation of the actuator 151 in the forward direction shown by the arrow in FIG. 22 different from the direction of rotation of the actuator 151 prior to rotation of the actuator 151 permits the interlocking member 153 to operate the piezoelectric unit 8 to the reset position S as shown in FIG. 22. That is, the piezoelectric unit 8 can generate a discharge voltage by subsequently operating it to the discharge position P.

In the initial state where the auxiliary operation of the actuator 151 has not been carried out, the fulcrum member 152 for the actuator member 151 is in the rearward position in the bearing groove 134*a* of the bearing portion 134 and the piezoelectric unit 8 has not been reset. Rotation of the actuator 151 in this state cannot cause the piezoelectric unit 8 to discharge an electric voltage. That is, ignition of the igniter is disabled. When auxiliary operation to move forward the actuator 151 in the direction of the arrow in FIG. 22 overcoming the force of the reset prevention member 260 is carried out, the piezoelectric unit 8 can be reset and rotation of the actuator 151 causes the piezoelectric unit 8 to discharge an electric voltage in response to rearward movement of the piezoelectric unit 8 to the discharge position P, whereby gas discharged from the gas nozzle is ignited. Rotation of the actuator 151 may be carried out in the rearward position after the auxiliary operation.

When rotation and auxiliary operation of the actuator 151 is released to interrupt use of the igniter, the interlocking member 153 and the actuator 151 are rotated in the reverse direction and are moved forth to return to the initial position shown in FIG. 21, where return of the piezoelectric unit 8 to the reset position S is prevented by the reset prevention member 260, under the force of the return spring in the piezoelectric unit 8. That is, the igniter is automatically returned to a state where ignition of the igniter by a simple rotation of the actuator 151 is disabled.

Also, in accordance with this embodiment, ignition lock to prevent the igniter from being ignited by simple rotation of the actuator 151 can be ensured and the ignition lock can be released in a series of actions and at the same time, an automatic return of the igniter to the locked state can be obtained. Further, the operability of the igniter is excellent.

Fifth Embodiment

Figure 24:
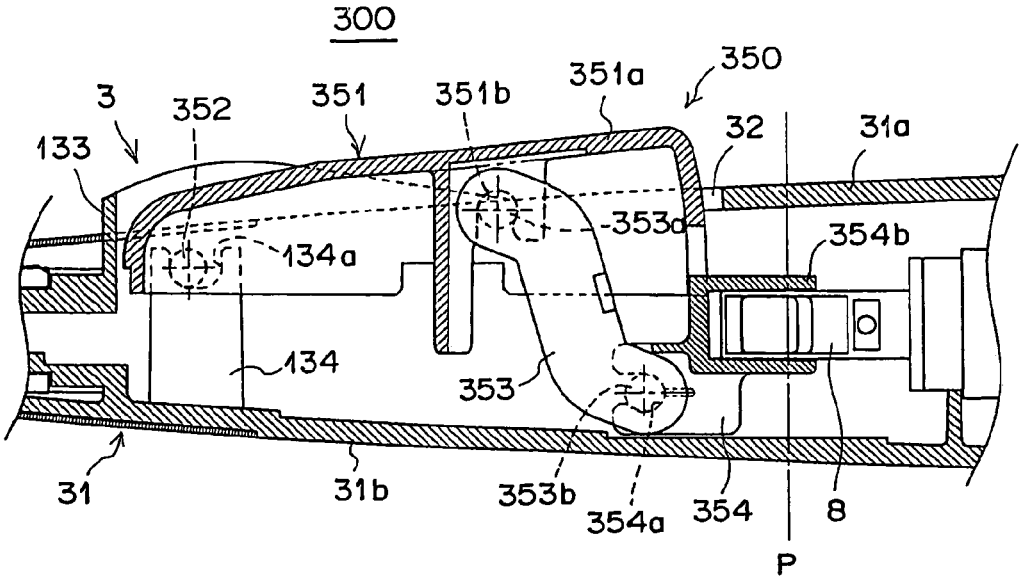
FIG. 24 is a side view partly in cross-section showing the actuator mechanism of an igniter in accordance with a fifth embodiment of the present invention in its non-operated state.
Figure 25:
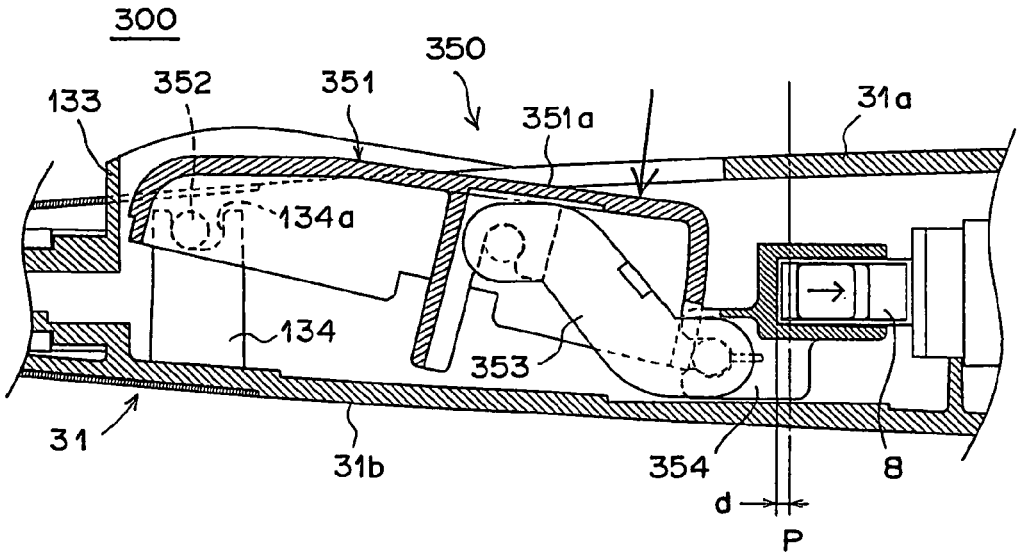
FIG. 25 is a side view partly in cross-section showing the actuator mechanism of the igniter shown in FIG. 24 for illustrating rotation of the actuator.
Figure 26:
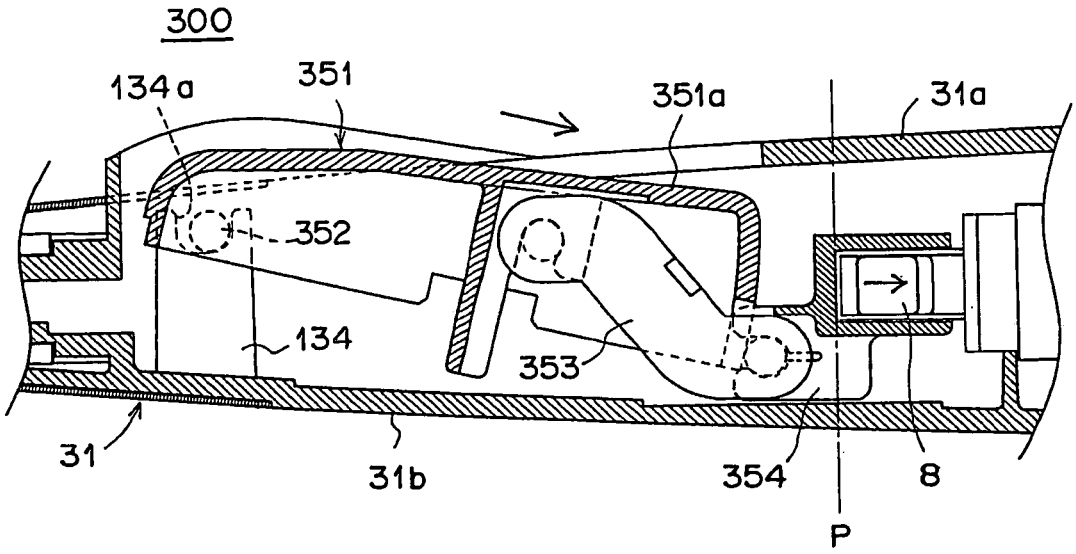
FIG. 26 is a side view partly in cross-section showing the actuator mechanism of the igniter in a state where the auxiliary operation has been further done from the state shown in FIG. 25.

FIGS. 24 to 26 show an igniter in accordance with another embodiment of the present invention. FIG. 24 is a side view partly in cross-section showing the actuator mechanism in its non-operated state, FIG. 25 is a side view partly in cross-section showing the actuator mechanism of the igniter shown in FIG. 24 for illustrating rotation of the actuator, and FIG. 26 is a side view partly in cross-section showing the actuator mechanism of the igniter in a state where the auxiliary operation has been further done from the state shown in FIG. 25.

The igniter (igniting rod) 300 of this embodiment somewhat differs from the preceding embodiment in appearance and differs from the preceding embodiment in operation of the actuator mechanism 350 and interlocking structure, and accordingly, the elements analogous in their functions even if they are different in their shapes are given the same reference numerals.

The actuator mechanism 350 of the igniter 300 of this embodiment comprises a rotatable actuator 351, a shaft-like fulcrum member 52 about which a forward end of the actuator 351 is rotated, an interlocking member 353 (a link member) which operates the piezoelectric unit 8 in response to rotation of the actuator 51, and a pushing member 354 which is mounted on the front end of the piezoelectric unit 8.

The upper surface of the actuator 351 is inclined to be higher rearward to form an actuating portion 351*a*, and when the igniter 1 is to be ignited, i.e., for igniting operation, a user's finger is applied to the actuating portion 351*a* and the rear end portion of the actuating portion 351*a* is depressed so that the actuator 351 is rotated. The igniting operation of the actuator 351 involves rotation of the actuator 351 about the fulcrum member 352 and an auxiliary operation of the same in a direction different from the direction of rotation to be done in continuous with rotation of the actuator 351. In this particular embodiment, the auxiliary operation of the actuator 351 is rearward movement of the actuator 351 in the direction of operation of the piezoelectric unit 8. The piezoelectric unit 8 discharges a discharge voltage when it is moved rearward to a discharge position P.

The actuator 351 is provided with a fulcrum member 352 which is like a round rod laterally extending on opposite sides of the front end portion of the actuator 351, and the fulcrum member 352 is held for rotation and back-and-forth movement by bearing grooves 134*a* formed to be long back and forth in the top ends of the bearing portions 134 erected on the bottom of the lower half 31*b* of the igniter body casing 31 on opposite sides of the bottom of the lower half 31*b*, whereby the rear end portion of the actuator 351 is rotatable and the whole actuator 351 is movable back and forth in parallel to the direction of operation of the piezoelectric unit 8.

Further, the actuator 351 is provided with an engagement groove 351*b* which opens downward at an intermediate portion thereof, and a front end shaft portion 353*a* of a link-like interlocking member 353 is engaged for rotation with the engagement groove 351*b*. A rear end shaft portion 353*b* is engaged for rotation with an engagement groove 354*a* of the pushing member 354 which opens forward at the front face of the pushing member 354. The front end portion of the piezoelectric unit 8 is inserted into an insertion portion 354*b* of the pushing member 354 directed rearward.

The interlocking member 353 is rotated in response to rotation of the actuator 351 and causes the pushing member 354 to slide back and forth, and interlocks the actuator 351 and the pushing member 354 with each other so that the pushing member 354 is moved rearward to operate the piezoelectric unit 8 when the actuator 351 is rotated.

A window portion 32 opens in the upper half 31*a* of the igniter body casing 31 and the actuator 351 is disposed in the window portion 32. A protective portion 133 projects from the upper half 31*a* of the igniter body casing 31 along the peripheral edge of the window portion 32. The protective portion 33 is formed to surround the forward portion of the actuator 351 with its front portion higher.

The actuator 351 is arranged so that the fulcrum member 352 is positioned in the forward position in the bearing groove 134*a* of the bearing portion 134 as shown in FIG. 24 in the non-operated state or the returned state and a maximum rotation of the actuator 351 in the direction of the arrow in this state causes the interlocking member 353 to operate the piezoelectric unit 8 by an amount smaller than the amount of operation to the discharge position P by an amount d as shown in FIG. 25. That is, the piezoelectric unit 8 can discharge no electric voltage in this state.

The amount of movement of the auxiliary operation to move the fulcrum member 352 to the rearward position in the bearing groove 134*a* of the bearing portion 134 is larger than the amount d so that, in addition to rotation of the actuator 351, auxiliary operation of the actuator 351 in the rearward direction shown by the arrow different from the direction of rotation of the actuator 151 can cause the interlocking member 353 to operate the piezoelectric unit 8 to the discharge position P as shown in FIG. 26. That is, the piezoelectric unit 8 can generate a discharge voltage. These functions are the same as in the third embodiment.

In this embodiment, unless the auxiliary operation of the actuator 351, the fulcrum member 352 is positioned in the forward position in the bearing groove 134*a* of the bearing portion 134 as shown in FIG. 24 and rotation of the actuator 151 in this state causes the interlocking member 353 (a link member) to operate the piezoelectric unit 8 by an amount smaller than the amount of operation to the discharge position P by an amount d as shown in FIG. 25. That is, the igniter is disabled from ignition. When the auxiliary operation to move rearward the actuator 151 as shown by the arrow in FIG. 26 is carried out in addition to rotation of the actuator 151, the interlocking member 353 comes to be able to operate the piezoelectric unit 8 to the discharge position P as shown in FIG. 26. That is, the piezoelectric unit 8 can generate a discharge voltage to ignite gas discharged from the gas nozzle. The auxiliary operation may be carried out prior to rotation of the actuator 151.

When rotation and auxiliary operation of the actuator 351 is released to interrupt use of the igniter, the interlocking member 353 and the actuator 351 are rotated in the reverse direction and are moved forth to return to the initial position shown in FIG. 24 under the force of the return spring in the piezoelectric unit 8. That is, the igniter is automatically returned to a state where ignition of the igniter is disabled.

Also, in accordance with this embodiment, provided with an actuator mechanism 350 comprising an actuator 351 supported at its front end and an interlocking member 353, ignition lock to prevent the igniter from being ignited by simple rotation of the actuator 351 can be ensured and the ignition lock can be released in a series of igniting actions and at the same time, an automatic return of the igniter to the locked state can be obtained. Further, the operability of the igniter is excellent.

Sixth Embodiment

Figure 27:
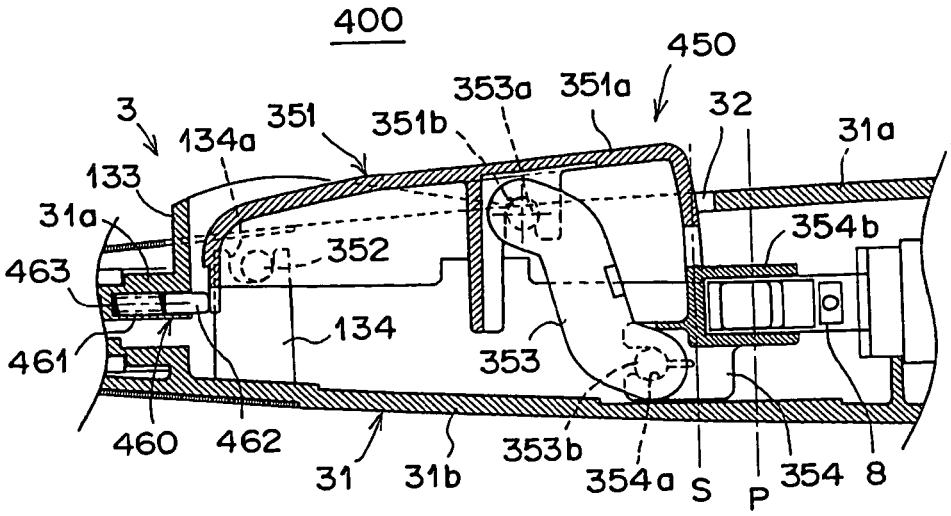
FIG. 27 is a side view partly in cross-section showing the actuator mechanism of an igniter in accordance with a sixth embodiment of the present invention in its non-operated state.
Figure 28:
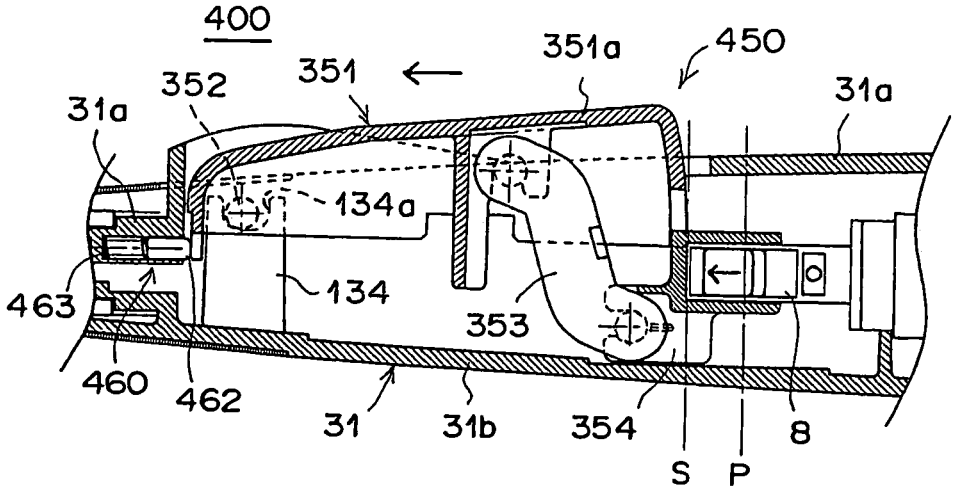
FIG. 28 is a side view partly in cross-section showing the actuator mechanism of the igniter shown in FIG. 27 for illustrating the auxiliary operation.
Figure 29:
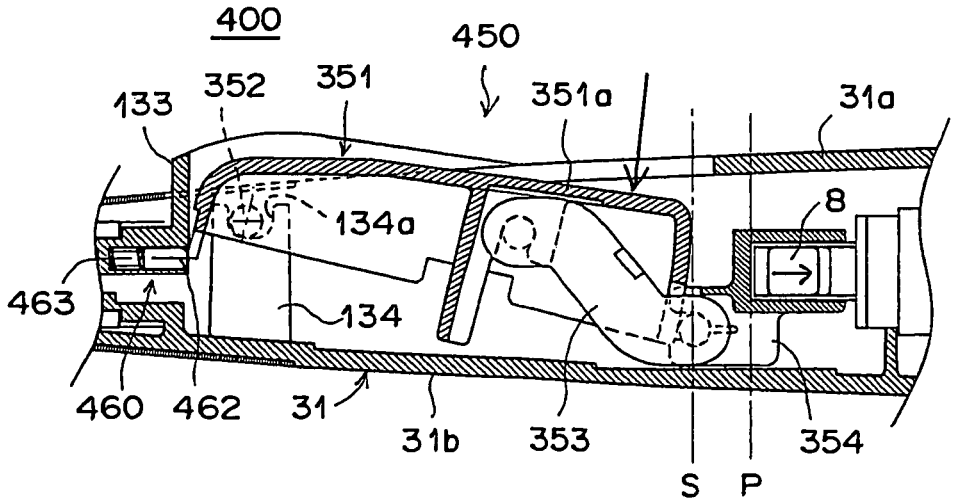
FIG. 29 is a side view partly in cross-section showing the actuator mechanism of the igniter in a state where rotation of the actuator has been further done from the state shown in FIG. 28.

FIGS. 27 to 29 show an igniter in accordance with another embodiment of the present invention. FIG. 27 is a side view partly in cross-section showing the actuator mechanism in its non-operated state, FIG. 28 is a side view partly in cross-section showing the actuator mechanism shown in FIG. 27 after the auxiliary operation has been done, and FIG. 29 is a side view partly in cross-section showing the actuator mechanism in a state where the actuator has been rotated from the state shown in FIG. 28.

The igniter (igniting rod) 400 of this embodiment is the same as the fifth embodiment except the actuator mechanism 450, and accordingly, the analogous elements are given the same reference numerals. Further, the igniting operation is based on a technical concept similar to that of the fourth embodiment.

The actuator mechanism 450 in this embodiment comprises an actuator 351 supported at its front end and an interlocking member 353 in the form of a link member which are similar to those of the fifth embodiment. The actuator 351 is held by a fulcrum member 352 on opposite sides of its front portion for rotation and back-and-forth movement along bearing grooves 134*a* formed to be long back and forth in the top ends of the bearing portions 134 in parallel to the direction of operation of the piezoelectric unit 8 and the interlocking member 353 which operatively couples the actuator 351 and a pushing member to operate the piezoelectric unit 8 is accommodated in the actuator 351.

The igniting operation of the actuator 351 involves rotation of the actuator 351 about the fulcrum member 352 and an auxiliary operation of the same in a direction different from the direction of rotation to be done before the rotation of the actuator 351 in continuous therewith. In this particular embodiment, the auxiliary operation of the actuator 351 is forward movement of the whole actuator 351 in the direction reverse to the direction of operation of the piezoelectric unit 8. The piezoelectric unit 8 discharges an electric voltage when it is moved rearward to the discharge position P and when it is returned to the reset position S, the piezoelectric unit 8 comes to be able to discharge again.

The actuator mechanism 450 is provided with a reset prevention member 460 which prevents the piezoelectric unit 8 from being moved forward up to the reset position S. The reset prevention member 460 comprises a pressing member 462 which slides back and forth in a guide portion 461 provided on the upper half 31*a* of the igniter body casing 31 forward of the actuator 351, and the pressing member 462 is urged rearward by a coiled spring 463 (may be resilient material such as a leaf spring, a resin spring or the like). The rear end of the pressing member 462 constantly abuts against the front end of the actuator 351 even if the actuator 351 is rotated to urge rearward the actuator 351 so that the piezoelectric unit 8 cannot be fully returned to the initial position.

In the non-operated state or the returned state from the preceding igniting action shown in FIG. 27, the reset prevention member 460 urges rearward the piezoelectric unit 8 by way of the actuator 351 and the interlocking member 353 so that the piezoelectric unit 8 stops short of the reset position S. That is, the reset prevention member 460 prevents movement of the fulcrum member 352 to the rearward position in the bearing groove 134*a* until the auxiliary operation of the actuator 351 is done. In the non-operated state, the piezoelectric unit 8 cannot be reset and rotation of the actuator 151 from this position cannot cause the piezoelectric unit 8 to discharge an electric voltage even if the piezoelectric unit 8 is operated to the discharge position P.

The amount of movement of the auxiliary operation to move the fulcrum member 352 to the forward position in the bearing groove 134*a* of the bearing portion 134 is to permit the piezoelectric unit 8 to return to the reset position S so that auxiliary operation of the actuator 351 in the forward direction shown by the arrow in FIG. 28 different from the direction of rotation of the actuator 351 prior to rotation of the actuator 351 permits the interlocking member 353 to operate the piezoelectric unit 8 to the reset position S as shown in FIG. 28. That is, the piezoelectric unit 8 can generate a discharge voltage by subsequently operating it to the discharge position P.

In the initial state where the auxiliary operation of the actuator 351 has not been carried out, the fulcrum member 352 for the actuator member 351 is in the rearward position in the bearing groove 134*a* of the bearing portion 134 as shown in FIG. 27 and the piezoelectric unit 8 has not been reset. Rotation of the actuator 351 in this state cannot cause the piezoelectric unit 8 to discharge an electric voltage. That is, ignition of the igniter is disabled. When auxiliary operation to move forward the actuator 351 in the direction of the arrow in FIG. 28 overcoming the force of the reset prevention member 460 is carried out, the piezoelectric unit 8 can be moved to the reset position S and subsequent rotation of the actuator 351 as shown in FIG. 29 causes the piezoelectric unit 8 to discharge an electric voltage in response to rearward movement of the piezoelectric unit 8 to the discharge position P, whereby gas discharged from the gas nozzle is ignited. Rotation of the actuator 351 may be carried out in the rearward position after the auxiliary operation.

When rotation and auxiliary operation of the actuator 351 is released to interrupt use of the igniter, the interlocking member 353 and the actuator 351 are rotated in the reverse direction and are moved forth to return to the initial position shown in FIG. 27, where return of the piezoelectric unit 8 to the reset position S is prevented by the reset prevention member 260, under the force of the return spring in the piezoelectric unit 8. That is, the igniter is automatically returned to a state where ignition of the igniter by a simple rotation of the actuator 351 is disabled.

Also, in accordance with this embodiment, ignition lock to prevent the igniter from being ignited by simple rotation of the actuator 351 can be ensured and the ignition lock can be released in a series of actions and at the same time, an automatic return of the igniter to the locked state can be obtained. Further, the operability of the igniter is excellent.

Though, not shown, the mechanism of the first or second embodiment of the present invention described above where the ignition lock is obtained by the lock member and the ignition lock is released by the auxiliary operation of the actuator in a direction different from the direction of rotation can be applied to the mechanism of the fifth or sixth embodiment of the present invention described above where the front end of the actuator is supported for rotation on the fulcrum member 352 and an interlocking member 353 in the form of a link member is provided.

Seventh Embodiment

Figure 30:
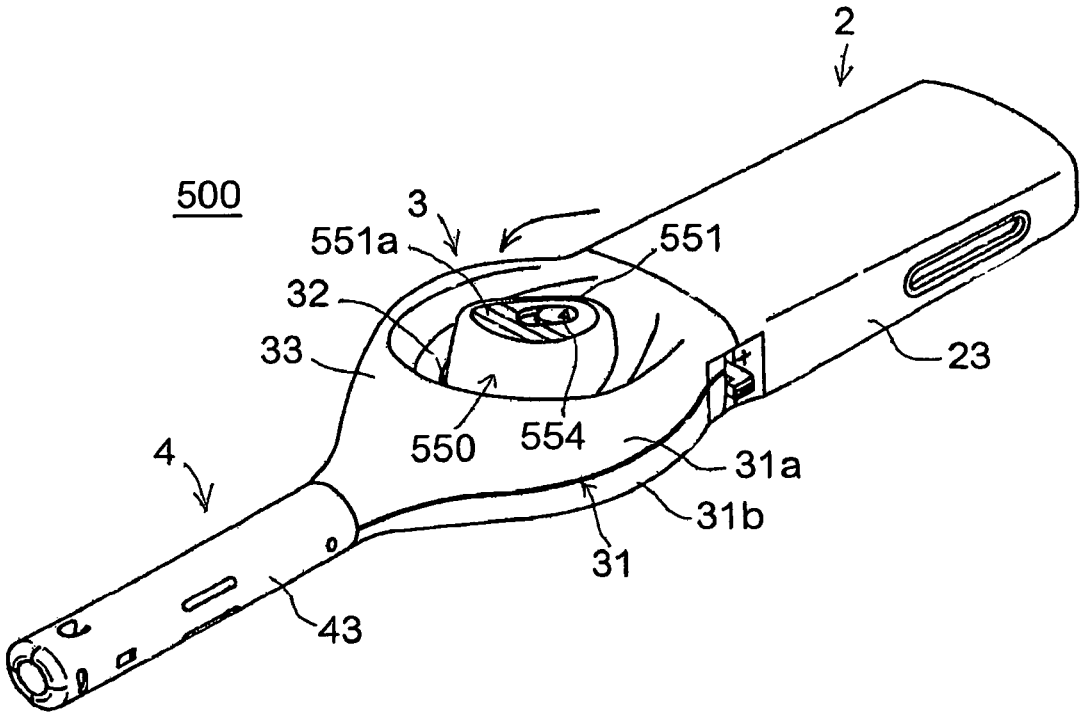
FIG. 30 is a perspective view showing an appearance of an igniter in accordance with a seventh embodiment of the present invention.
Figure 31:
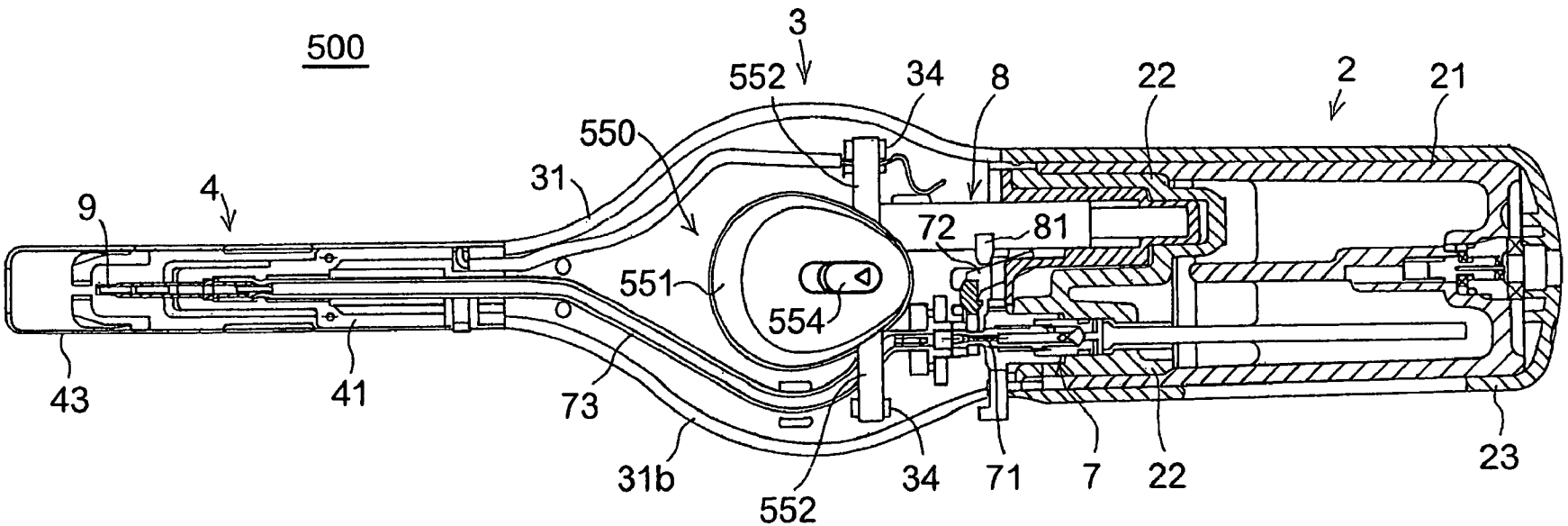
FIG. 31 is a cross-sectional view of the igniter taken along a horizontal medial plane.
Figure 32:
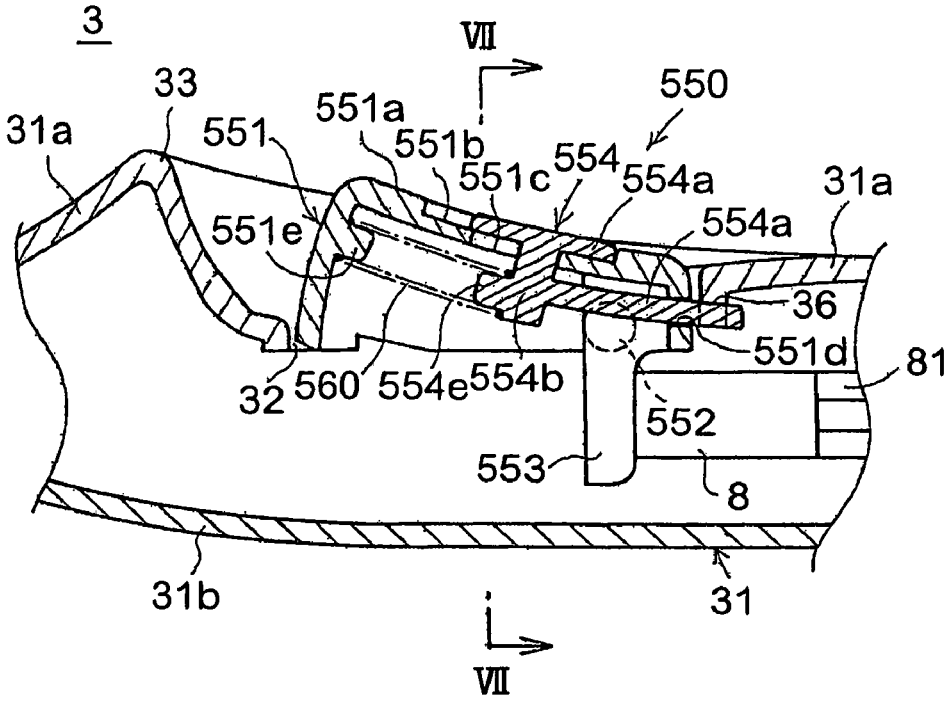
FIG. 32 is a side view partly in cross-section showing the actuator mechanism of the igniter shown in FIG. 30.
Figure 33:
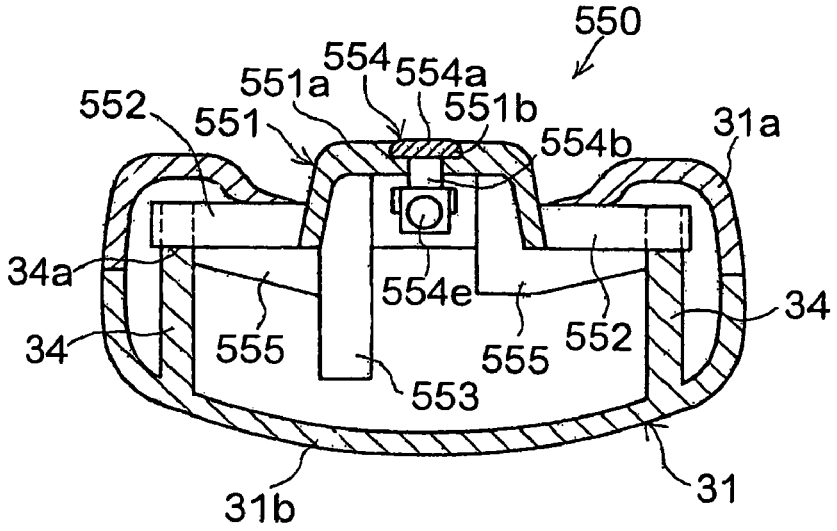
FIG. 33 is a cross-sectional view taken along line VII-VII in FIG. 32.
Figure 34:
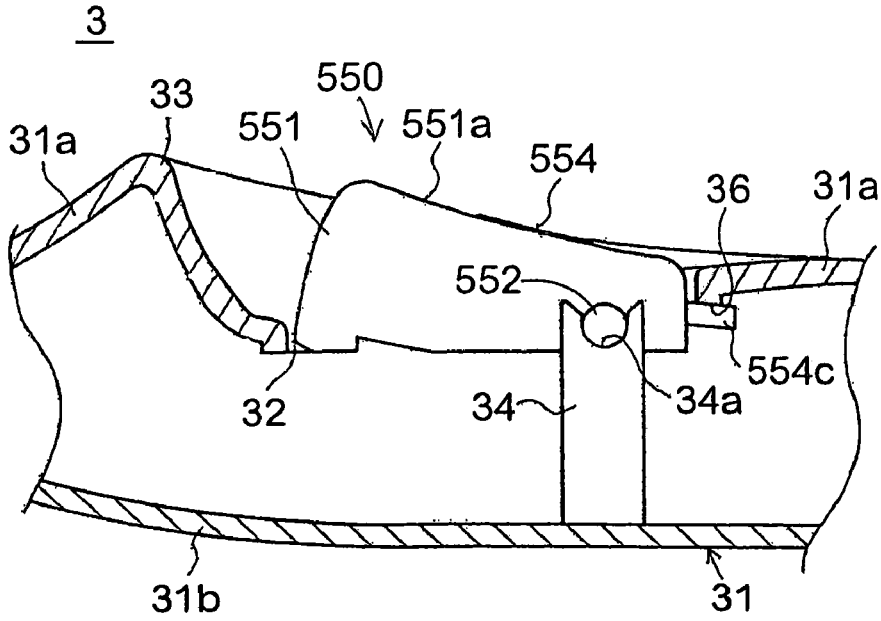
FIG. 34 is a side view partly in cross-section showing the support structure of the actuator mechanism shown in FIG. 30.
Figure 35:
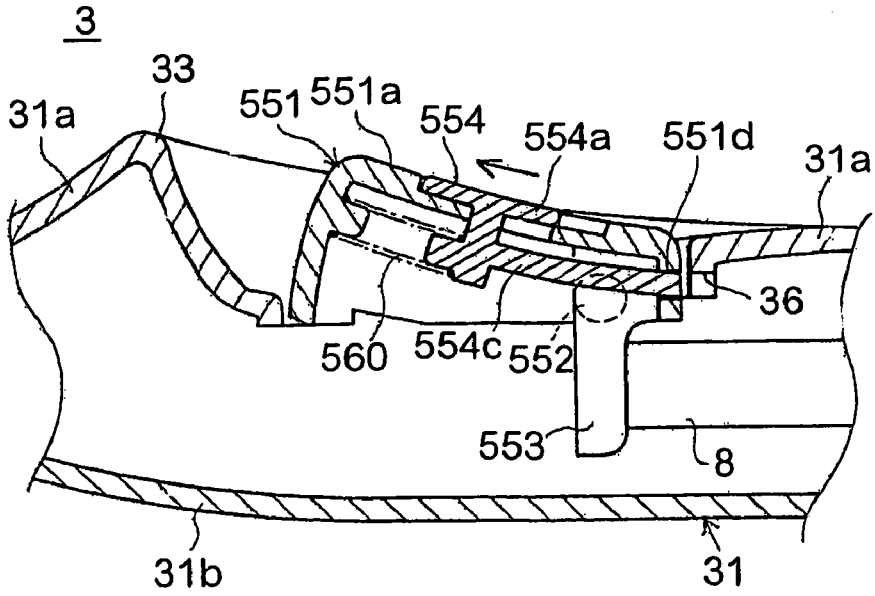
FIG. 35 is a side view partly in cross-section showing an important part of the actuator mechanism shown in FIG. 32 but in a lock release state.
Figure 36:
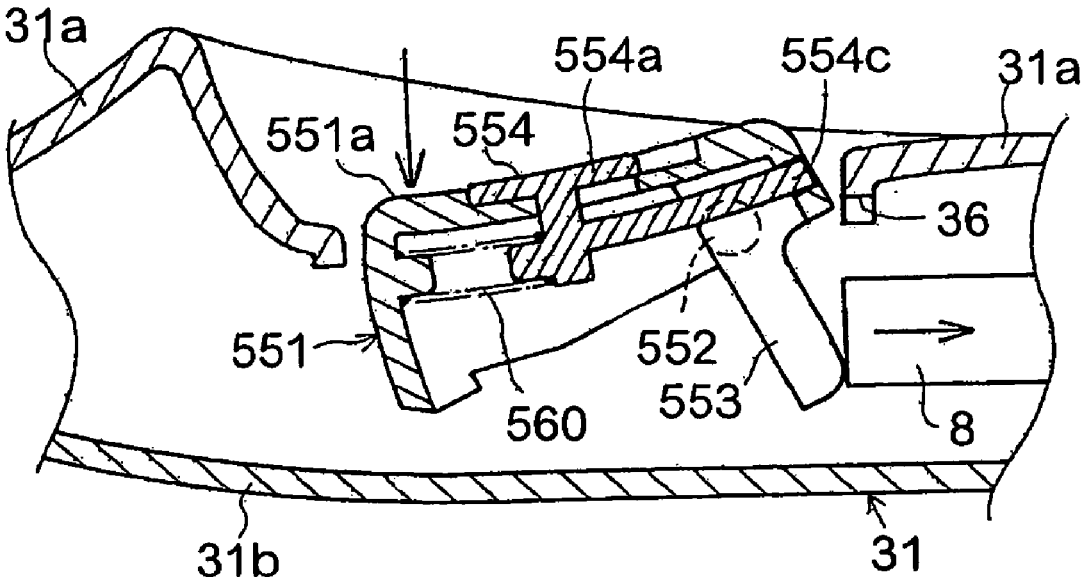
FIG. 36 is a side view partly in cross-section showing the important part of the actuator mechanism shown in FIG. 32 in its igniting state.

The igniter of this embodiment is in the form of an igniting rod and is shown in FIGS. 30 to 36. FIG. 30 is a perspective view showing an appearance of the igniter, FIG. 31 is a cross-sectional view of the igniter taken along a horizontal medial plane, FIG. 32 is a plan view partly in cross-section showing the actuator mechanism of the igniter, FIG. 33 is a cross-sectional view taken along line VII-VII in FIG. 32, FIG. 34 is a side view partly in cross-section showing the support structure of the actuator mechanism, FIG. 35 is a side view partly in cross-section showing the actuator mechanism shown in FIG. 32 but in a lock release state, and FIG. 36 is a side view partly in cross-section showing the actuator mechanism in its igniting state. The igniter (igniting rod) 500 of this embodiment is the same as the first embodiment except the actuator mechanism 550, and accordingly, the analogous elements are given the same reference numerals.

The actuator mechanism 550 in this embodiment comprises the actuator 551 which is rotatable and is provided with an actuating portion 551*a* on its surface, a shaft-like fulcrum member 552 about which the actuator 551 is rotated in a direction perpendicular to the centerline of the valve mechanism 7, an interlocking member 553 (an interlocking lever) which operates the piezoelectric unit 8 in response to rotation of the actuator 551, a lock member 554 which makes an ignition lock, by inhibiting rotation of the actuator 551 and an urging member 560 which urges the lock member 554 toward its locking position.

The actuator 551 of the actuator mechanism 550 is ellipsoidal in plan and higher in the front portion facing the rod-like portion 4 than the rear portion. That is, the upper surface of the actuator 551 forming the actuating portion 551*a* is inclined to be higher forward, and when the igniter is to be ignited, a user's finger is applied to the actuating portion 551*a* and the actuating portion 551*a* is pushed forward.

As shown in FIGS. 32 to 34, the base end of the fulcrum member (rotary shaft) 552 which is like a laterally extending round rod is fixed to the lower portion of the actuator member 51 near to the reservoir portion 2 on opposite sides of the actuator 51 and a pair of bearing portions 34 are erected on the bottom of the lower half 31*b* of the igniter body casing 31 on opposite sides of the bottom of the lower half 31*b*. A bearing groove 34*a* (FIG. 34) open at the upper end thereof is formed in the top end of each of the bearing portions 34. The fulcrum member 552 is received in the bearing grooves 34*a* of the bearing portions 34, whereby the actuator 551 is supported on the fulcrum member 552 so that the front end portion thereof is rotatable.

The lock member 554 which is provided on the actuator 551 comprises an actuating portion 554*a* slidable along the actuating portion 551*a* of the actuator 551 and a lock portion 554*c* which is connected to the actuating portion 554*a* by way of a connecting portion 554*b* and has a rear end portion which can be projected from the actuator 551 to interfere with the igniter body casing 31 and can be retracted into the actuator 551. The lock member 554 is urged by the urging member 560 in the direction where its rear end portion is projected from the actuator 551.

A groove 551*b* is formed in the actuator 551 to longitudinally extend substantially at the center of the actuating portion 551*a*, and an elongated hole 551*c* is formed inside the groove 551*b* to longitudinally extend and to extend through the actuating portion 551*a*. A plate-like actuating portion 554*a* of the lock member 554 is inserted to be slidable into the groove 551*b*, the connecting portion 554*b* projecting downward from the lower surface of the actuating portion 554*a* is inserted to be slidable into the elongated hole 551*c*, and the lock portion 554*c* extends rearward from the lower end portion of the connecting portion 554*b*. The rear end portion of the lock portion 554*c* is inserted into an insertion hole 551*d* extending through the rear wall of the actuator 551 to be projected from and retracted into the actuator 551 in response to slide of the actuating portion 554*a*.

A protective portion 33 of the upper half 31*a* of the igniter body casing 31 is provided rearward of the window portion 32 with an engagement portion 36 adapted to be engaged with the lock portion 554*c*. When the former and the latter are engaged with each other, rotation of the actuator 551 is inhibited and the igniter is brought into the ignition locked state. The ignition lock is released by sliding the lock member 554 along the actuating portion 551*a* of the actuator 551 to disengage the lock member 554 from the engagement portion 36, thereby permitting rotation of the actuator 551.

A projections 554*e* and 551*e* are provided on the front surface of the connecting portion 554*b* and on the inner surface of the front wall of the actuator 551 and the urging member 560 in the form of a coiled spring is compressed between the projections to urge the lock member 554*c* in the direction where the lock portion 554*c* is projected.

Though, in the illustrated embodiment, the lock member 554 is mounted to be linearly slidable back and forth to make the ignition lock and to release the ignition lock, the lock member 554 may be mounted to be laterally movable back and forth or to be rotatable back and forth, so that a part of the lock portion 554*c* is projected from the actuator 551 to interfere with the igniter body casing 31 in response to movement of the lock member 554. For the purpose of mounting the lock member 554 on the actuator 551, the lock member 554 or the actuator 551 is of a split structure, if necessary.

The actuator 551 is provided with an interlocking member 553 extending downward from the rear end portion of the actuator 551. The front end of the piezoelectric unit 8 abuts against the lower rear end of the interlocking member 553 so that the piezoelectric unit 8 is moved rearward by the interlocking member 553 in response to rotation of the actuator 551. The return spring (not shown) built in the piezoelectric unit 8 urges the interlocking member 53 toward its initial position, whereby the front end portion of the actuator 51 is urged to rotate upward.

As shown in FIG. 33, a reinforcing rib 555 extending from the actuator 551 to the lower end of the fulcrum member 552 on opposite sides of the actuator 551 reinforces the fulcrum member 552. Though, in the above embodiment, the fulcrum member 552 is fixed to the actuator 551, the fulcrum member 552 may be mounted on the igniter body casing 31 to support the actuator 551 for rotation.

Operation of the igniter 500 of this embodiment will be described, hereinbelow. That is, when the igniter 500 is in its non-operated state (left to stand still) where the actuator 551 and the lock member 554 are not operated as shown in FIGS. 30 to 34, the lock member 554 is held in its rearward position under the force of the urging member 6 where the lock portion 554*c* is projected from the actuator 551, and the lock portion 554*c* interferes with the engagement portion 36. In this state, the actuator 551 cannot be rotated and the igniter 500 is locked.

When the igniter 500 is to be ignited, a finger is applied to the actuating portion 554*a* of the lock member 554 in the actuating portion 551*a* of the actuator 551, and the lock member 554 is moved forward in the direction of the arrow overcoming the force of the urging member 560 as shown in FIG. 35. By the lock release operation, the rear end portion of the lock portion 554*c* is depressed in the actuator 551 and disengaged from the engagement portion 36, whereby the igniter 500 is turned to the lock release state, where rotation of the actuator 551 is permitted.

When the front end portion of the actuator 551 is depressed in the direction of the arrow shown in FIG. 35 to rotate the actuator 551 with the lock member 554 held in the lock release position, the interlocking member 553 moves rearward the piezoelectric unit 8, whereby gas is supplied to the gas nozzle 9 and a discharge voltage is generated, whereby the discharged gas is ignited.

When depression of the actuator 551 is released for interrupting use of the igniter 500, the actuator 551 is rotated in the reverse direction to return to the initial position by way of the interlocking member 553 under the force of the return spring (not shown) in the piezoelectric unit 8 and at the same time, when the actuating portion 554*a* of the lock member 554 is released from the finger, the lock member 554 is moved rearward to the position where the lock portion 554*c* is projected and interferes with the engagement portion 36 under the force of the urging member 560, whereby the igniter 500 is automatically returned to the locked state. When the lock member 554 is released from the finger before the actuator 551 is rotated to the initial position, the lock portion 554*c* attempts to project from the actuator 551 under the force of the urging member 560. However, the lock portion 554*c* slides on the surface of the upper half 31*a* of the igniter body casing 31 and projects in the interfering position to return to the initial position.

In accordance with this embodiment, it is necessary to perform, prior to rotation of the actuator 551, a lock release operation to slide the actuating portion 554*a* of the lock member 554. In an unused state, the lock member 554 and the engagement portion 36 are constantly engaged with each other to disable the igniter 500 from being ignited, and after use of the igniter 500, the igniter 500 is automatically returned to the locked state. Accordingly, inadvertent ignition of the igniter can be prevented, and at the same time, the lock release operation and rotation of the actuator for ignition can be smoothly carried out, whereby good operability can be obtained.

Further, the igniting mechanism for generating a discharge voltage may comprise a discharge circuit using a cell in place of the piezoelectric unit 8.

The invention claimed is:

1. An igniter comprising a gas nozzle which is disposed in an end portion of a rod-like portion and discharges gas, a reservoir storing therein fuel, a valve mechanism for controlling supply of gas from the reservoir to the gas nozzle, an ignition mechanism which generates a discharge electric voltage for igniting the gas discharged from the gas nozzle, and an actuator mechanism which is operated to accomplish an igniting action of igniting the gas discharged from the gas nozzle, wherein the improvement comprises a rotatable actuator, said actuator mounted on a fulcrum member, said fulcrum member supported on an igniter body casing and about which the actuator is rotated, the fulcrum member capable of moving toward the ignition mechanism as the actuator rotates, and an interlocking member extending from said rotatable actuator, whereby the igniting action of the actuator involves rotation of the actuator about the fulcrum member in one direction and an auxiliary operation of the actuator to move the fulcrum member toward the ignition mechanism to be done in continuous with rotation of the actuator in a direction different from said one direction, thereby causing said interlocking member to operate the ignition mechanism in response to rotation of the actuator and the movement of the fulcrum member, with the actuator mechanism automatically returned to its initial state in response to return of the actuator to its initial position.

2. An igniter as defined in claim 1 in which the fulcrum member extends like a stem on each side of the actuator to be fixed thereto and be supported by a bearing portion, fixed to the igniter body casing, to be able to support the actuator for rotation and to be moved in the auxiliary operation in a direction perpendicular to the direction of the axis of rotation of the actuator.

3. An igniter as defined in claim 1 in which the interlocking member comprises a link member which transmits rotation of the actuator to the ignition mechanism.

4. An igniter comprising a gas nozzle which is disposed in an end portion of a rod-like portion and discharges gas, a reservoir storing therein fuel, a valve mechanism for controlling supply of gas from the reservoir to the gas nozzle, an ignition mechanism which generates a discharge electric voltage for igniting the gas discharged from the gas nozzle, and an actuator mechanism which is operated to accomplish an igniting action of igniting the gas discharged from the gas nozzle, wherein the improvement comprises that the actuator mechanism comprises a rotatable actuator, a fulcrum member which is supported on an igniter body casing and about which the actuator is rotated, the fulcrum member capable of moving toward the ignition mechanism as the actuator rotates, and an interlocking member which operates the ignition mechanism in response to rotation of the actuator and the movement of the fulcrum member, wherein rotation of the actuator is set so that the rotation of the actuator by way of the interlocking member causes the ignition mechanism to be operated by an amount not sufficient to discharge electric voltage, the actuator is movable to a position where it can operate the igniting member by way of the interlocking member by an amount sufficient to discharge electric voltage by an auxiliary operation of the actuator in a direction different from the direction of the rotation of the actuator, and the igniting action of the actuator involves in addition to rotation of the actuator about the fulcrum member, an auxiliary operation of the actuator in a direction different from the direction of the rotation of the actuator to a position where it can operate the igniting member by way of the interlocking member by an amount sufficient to discharge electric voltage.

5. An igniter as defined in claim 4 in which the auxiliary operation of the actuator is an operation to move the position of the fulcrum of the actuator in parallel to the direction in which the ignition mechanism is operated.

6. An igniter as defined in claim 4 in which the interlocking member comprises a link member which transmits rotation of the actuator to the ignition mechanism.

* * * * *